US009986821B2

(12) United States Patent
Wiener et al.

(10) Patent No.: US 9,986,821 B2
(45) Date of Patent: Jun. 5, 2018

(54) ERGONOMIC KEYBOARD AND PERIPHERAL POSITIONING SYSTEM

(71) Applicant: THERMOGENESIS GROUP, INC., Bellevue, WA (US)

(72) Inventors: Ron Wiener, Mercer Island, WA (US); Andrew Rosenbaum, Mercer Island, WA (US); Cole Dalton, Mercer Island, WA (US)

(73) Assignee: THERMOGENESIS GROUP, INC., Bellevue, WA (US)

( * ) Notice: Subject to any disclaimer, the term of this patent is extended or adjusted under 35 U.S.C. 154(b) by 0 days. days.

(21) Appl. No.: 15/508,970

(22) PCT Filed: Sep. 11, 2015

(86) PCT No.: PCT/US2015/049582

§ 371 (c)(1),
(2) Date: Mar. 6, 2017

(87) PCT Pub. No.: WO2016/040739

PCT Pub. Date: Mar. 17, 2016

(65) Prior Publication Data

US 2017/0273454 A1 Sep. 28, 2017

Related U.S. Application Data

(60) Provisional application No. 62/048,973, filed on Sep. 11, 2014.

(51) Int. Cl.

| | |
|---|---|
| ***B68G 5/00*** | (2006.01) |
| ***A47B 21/03*** | (2006.01) |
| *A47F 5/00* | (2006.01) |

(52) U.S. Cl.
CPC ..... *A47B 21/0314* (2013.01); *A47B 21/0371* (2013.01); *A47B 2021/0307* (2013.01); *A47B 2021/0335* (2013.01); *A47B 2021/0342* (2013.01); *A47F 5/00* (2013.01)

(58) Field of Classification Search
USPC ..... 248/118
See application file for complete search history.

(56) References Cited

U.S. PATENT DOCUMENTS

| | | | | |
|---|---|---|---|---|
| 5,483,898 | A | 1/1996 | Seidl | |
| 5,704,299 | A * | 1/1998 | Corpuz, Jr. | A47B 21/0314 108/147 |
| 5,868,079 | A * | 2/1999 | Charny | A47B 21/00 108/147 |
| 6,116,557 | A * | 9/2000 | Choy | A47B 21/0314 108/93 |
| 6,158,359 | A * | 12/2000 | Allan | A47B 21/0314 108/1 |

(Continued)

OTHER PUBLICATIONS

International Search Report and Written Opinion for International (PCT) Patent Application No. PCT/US15/49582, dated Dec. 29, 2015 6 pages.

(Continued)

*Primary Examiner* — Monica E Millner
(74) *Attorney, Agent, or Firm* — Sheridan Ross P.C.

(57) ABSTRACT

A keyboard and keyboard and peripheral position system, which may be used with adjustable-height desks.

20 Claims, 52 Drawing Sheets

(56) References Cited

U.S. PATENT DOCUMENTS

| | | | | |
|---|---|---|---|---|
| 6,257,531 | B1 * | 7/2001 | Penner | A47B 21/0314 248/118 |
| 7,100,517 | B1 * | 9/2006 | Godwin | A47B 21/02 108/2 |
| 7,862,111 | B2 * | 1/2011 | Steenson | A47C 7/70 108/157.1 |
| 8,109,527 | B2 * | 2/2012 | Bustle | A61G 12/001 248/118.3 |
| 8,740,166 | B2 * | 6/2014 | Hamilton | A47B 21/0314 108/129 |
| 8,826,831 | B2 | 9/2014 | Hazzard et al. | |
| 9,441,784 | B2 * | 9/2016 | Russell | A47B 17/03 |
| 9,532,646 | B2 * | 1/2017 | Sears | A47B 21/0371 |
| 2005/0092216 | A1 * | 5/2005 | Lima | A47B 21/0314 108/93 |
| 2005/0105255 | A1 * | 5/2005 | Kirchhoff | A47B 21/0314 361/679.2 |
| 2006/0274045 | A1 | 12/2006 | Stenbroten | |
| 2007/0066466 | A1 | 3/2007 | Jones et al. | |
| 2007/0080564 | A1 * | 4/2007 | Chen | A47B 21/0314 297/162 |
| 2009/0138637 | A1 * | 5/2009 | Hargreaves | H01H 13/86 710/67 |
| 2013/0210576 | A1 | 8/2013 | Bilang | |

OTHER PUBLICATIONS

International Preliminary Report on Patentability for International (PCT) Patent Application No. PCT/US2015/049582, dated Mar. 23, 2017 5 pages.

* cited by examiner

ERGONOMIC KEYBOARD AND PERIPHERAL POSITIONING SYSTEM

CROSS REFERENCE TO RELATED APPLICATION

This application is a national stage application under 35 U.S.C. 371 of PCT Application No. PCT/US2015/049582 having an international filing date of Sep. 11, 2015, which designated the United States, which PCT application claimed the benefit of U.S. Provisional Application Ser. No. 62/048,973, filed Sep. 11, 2014, both of which are incorporated by reference in their entirety.

FIELD OF THE DISCLOSURE

This disclosure relates to a keyboard and peripheral position system for use with adjustable-height desks, standing desks, and treadmill desks used while performing typical office, home, or workplace tasks, such as electronic communication, computing, etc.

BACKGROUND

In recent years, the increasing use of standing desks, height-adjustable desks, and walking treadmills paired with a desk (possibly height adjustable), in a home or work environment, generates a need to have more flexibility in how keyboards and other peripherals can be adjusted due to the wider range of adjustments required to span sitting, standing, and walking while using these devices.

The use of standing desks and treadmill desks is becoming more commonplace. Standard computer keyboards are designed for use while sitting at a standard-height desk, often with the weight of the user's arms supported by chair arms. Typical keyboards provide for a means of small angle adjustment; however, these features only allow adjustment to increase the height of the edge of the keyboard furthest from the user. This direction of angle adjustment is opposite from what is ergonomically proper, which is why under-desk trays that can tilt the front edge of the keyboard higher than the back edge are sold. However, few people use such trays as they are very expensive and many desks have a drawer in the way or have too little available space between the bottom of the desk surface and the top of the user's lap to accommodate such a device comfortably.

Using a keyboard without an ergonomic under-desk tray to tilt the front edge of the keyboard up can lead to wrist pain and carpal tunnel syndrome as well as "computer hunch," which can misalign the neck and shoulders and lead to chronic pain issues for computer users. This is one of the worst maladies associated with "sitting disease" as documented in many health studies.

The advent of standing desks and treadmill desks (both of which can employ height-adjustable desks) has introduced even more serious ergonomic issues for the computer user.

Another problem with existing keyboard positioning systems is that they do not hold a keyboard solidly and rigidly in one position. The positioning systems flex, move, wobble, and wiggle when reasonable forces are applied to them. These systems can flex or move because there are multiple parts that connect in a chain between the mount to the desk and the keyboard surface. These multiple connections between parts are there because they provide other benefits such as retracting the keyboard under the desk when not in use and allowing the keyboard tray to articulate up to a desired height as the keyboard tray is pulled out and then up.

As a cumulative effect of the way these parts are connected, and the given machining tolerances of those connections, there is more opportunity for these parts to flex, or wiggle, and generally not be as solid, stable, or rigid. For example, a slide out drawer has two sliders that allow each side of the keyboard tray to slide out. Each of these sliders has an inner bar that slides inside an outer bar. This allows for some wiggle between the two parts. Some of these sliders may have bearings inserted between the inner and outer bar to reduce friction while they are sliding. All of the interfaces between parts allow for some wiggle room between the parts, which ultimately creates a less stable surface.

Another example is where there are movable joints that extend and hold the keyboard surface out in front of the table. Again, these movable adjustable joints are prone to wiggle due to the manufacturing tolerances and they extend the overall length of the lever arm where the majority of the weight and forces will be exerted.

Another problem with existing keyboard systems is that they are difficult and time-consuming to mount the first time and removing them and remounting them in other positions is equally complicated and time-consuming. There are other systems that do allow for quick mounting and un-mounting, but these are not as rigid or secure because they have independent mounts that are not directly connected to each other through one solid mechanism.

Another problem with existing keyboard positioning systems is typing while walking or resting hands on the keyboard system while walking. This motion can cause the keyboard surface to move, wobble, or wiggle. And, as a result, this motion can then cause the table and the computer monitor to move as well. This instability is made worse and exaggerated when there are many independent parts that are connected between the keyboard surface and the ultimate mount on the desk (e.g., "lily pad" or pull-out mouse platforms). Each independent component introduces more possibility for movement at each connection point between two components due to the manufacturing tolerances introduced by each part. These tolerances at connection points (i.e., joints) provide places for two parts to be able to move relative to each other thus making the system overall more susceptible to wiggling or wobbling at those joints or connection points. The walking motion itself is cyclic and those oscillations can cause the vibrations to grow and amplify causing even more extreme movement of the keyboard (and ultimately monitor) while a person is typing. This additional movement makes typing even harder to perform.

SUMMARY

This invention is designed to address the described problems and is universally adjustable to be used in a walking, standing, or sitting application. Some treadmill desk workstations allow for all three modalities in the same workstation. This device will reduce or eliminate pain from poor ergonomic positioning of the keyboard and mouse (or trackball) in all three modes.

The iMovR™ Elevon™ Ergonomic Sit-Stand-Walk Keyboard and Peripheral Positioning System is designed to allow a keyboard to be held rigidly and securely in an ergonomically-adjustable position for a person when they are sitting at a desk, standing at a desk, or walking on a treadmill in front of a desk. This system allows additional surfaces on either side (or both sides) of the keyboard surface to be independently adjusted into a customized ergonomic position to hold a mouse, trackball, independent number pad, or other pointing devices.

DETAILED DESCRIPTION

Figure 1A:
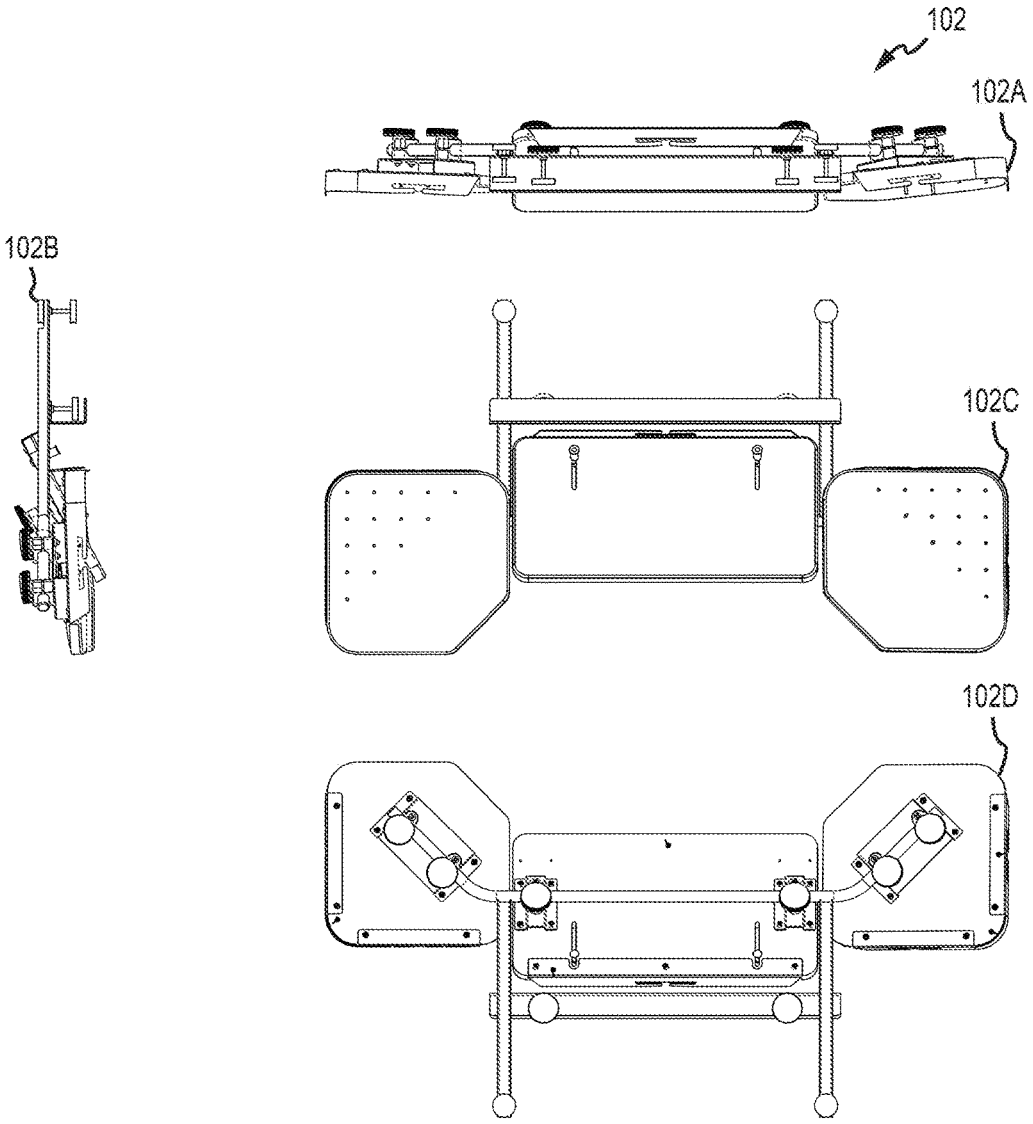
FIGS. 1A-1B illustrate multiple graphical projections of an embodiment of a keyboard and peripheral mounting system.

The ensuing description provides embodiments only and is not intended to limit the scope, applicability, or configuration of the claims. Rather, the ensuing description will provide those skilled in the art with an enabling description for implementing the embodiments. It will be understood that various changes may be made in the function and arrangement of elements without departing from the spirit and scope of the appended claims.

As an overview and one embodiment of the disclosure, a desktop is disclosed having a movable portion operable to accommodate a keyboard and moving to pitch away from a user when utilizing the keyboard. The purpose of tilting the keyboard up is to create a more neutral position for the arms and hands of the users in order to reduce or prevent this occurrence. This is particularly relevant when a user is utilizing a keyboard on an elevated work surface while standing or walking. (See, FIGS. 7A-B, 8A-B, and 9A-B).

In order to maintain a proper ergonomic position—i.e., keeping the arms and hands in as neutral a position as possible—the keyboard should be mounted at a much steeper angle than for desktop use. This could be anywhere from 20 to 60 degrees off the desktop plane. Using a keyboard when on a treadmill desk requires steeper angles than when sitting or standing due to the fact that the belt is constantly pulling the user backwards, causing them to press down harder on their palms in order to maintain hand position on the keyboard and typing accuracy. Lacking steeper angles, users eventually develop muscle strain in the neck and shoulders from maintaining hard downward pressure for extended periods. By working at a steeper angle this pressure is alleviated, resulting in the ability to type more accurately and faster typing speeds and treadmill belt speeds, plus reduced muscle strain.

The first component of the invention is a single solid mounting frame. For example, see FIG. 2, element 110. This frame is designed as a single piece to create the most rigid and secure system. This mounting frame has knobs that can be tightened and untightened quickly (no tools are needed) to securely fasten the frame to the table by creating a strong clamping force that holds a wide flat lip or plate against the top edge of the table. The large surface area of this plate provides significant friction between the top of the table, which results in an extremely strong and rigid connection. The plate can optionally have a padded interior surface to protect the desk from scratches and provide an even stronger grip.

The frame has arms that extend backward under the table. These arms provide several benefits. While attaching the frame, before it is tightened on, it keeps the front part of the frame, including the keyboard and peripheral surfaces, from swinging down and sliding forward off the desk. Instead, the arms that extend backward keep the frame in an upright position. Once the frame is attached and tightened to the table, these arms provide a secure counter lever that extends back from the edge to the center of the desk it is attached to. This causes any downward forces on the keyboard surface or peripheral surfaces on the front of the frame to be transferred to upward forces on the back end of the lever arm directly to the table top close to the center of gravity of the table. This is because the front lip/plate that attaches to the table top acts like the center of the lever. This result is a very strong and rigid mounting of the frame. This direct transfer does not introduce additional wiggle or wobble since it is one solid part, rather than multiple parts that could have additional room to wiggle or potentially fail to hold together under significant forces, such as if someone walking on a treadmill while typing stumbles and puts the majority of their body weight on the frame.

An additional benefit of the arms that extend backward under the table and the lip/plate that attaches in the front is that together they allow the frame to be mounted on a table top when the front underside edge is not entirely flat. Some desktops have frame members (or other obstructions) that are close to the front edge of the table top. These obstructions prevent other keyboard mounting systems from being used in these scenarios. Most adjustable-height desks have crossbars that block this installation of conventional keyboard trays. This frame mechanism requires a relatively shallow freeboard between the user edge of the desk and the crossbar allowing it to be mounted universally to almost any kind of desk—many more than any other keyboard tray design.

Another component of this system is the keyboard surface and how it mounts to the frame. The frame has a single rod or axle that the keyboard surface attaches to via mounting clamps. The mounting clamps provide the ability to mount the surface at any latitudinal angle. This complete adjustability allows any ergonomic angle to be achieved. This angle can be adjusted correctly for an individual, whether a person is sitting, standing, or walking at their desk. Another benefit of the surface and frame connection is that the axle, which is part of the single solid frame, extends entirely under the keyboard surface. All forces from someone pushing on the keyboard surface are conveyed directly downward on to the frame. Other systems have less secure and less strong connection points on the side of the keyboard surface. The other systems do not allow for the complete adjustability of the angle. Most other systems are limited in potential tilt angle of the keyboard platform by obstruction of the arm that connects them to the desk. And the mechanism for keeping the angle in place in the other systems does not have as much surface area for friction to hold the angle in place. Another embodiment of this would be instead of an axle or rod that would allow continuous adjustments, there may be a different a bar (rectangular or other polygon or grooved shape) combined with a corresponding clamp, which would allow for continuous or a finite number of adjustable positions.

An additional aspect of the clamps that attach the keyboard surface to the axle are the number of clamps. In the FIG. 2 (See below for a more detailed description of FIG. 2), two clamps are shown attaching the keyboard surface to the axle. This provides a very stable rigid connection point. Any number of clamps could be used. Another variant of this would be to have one clamp in the center of the keyboard surface and two supports on either end of the surface. A support keeps the keyboard surface a specific distance away from the axle. An example of would be half a clamp, but other variants are possible to achieve the same result. These supports provide a resting point for the ends of the keyboard tray to rest directly on the axle without requiring anything on the other side of the axle to hold it. This mechanism maintains the benefits of a strong rigid connection point of the first system. The additional benefit of this is that there is less apparatus under the tray that can get in the way of a person's knees or thighs when they are using the keyboard tray in the sitting position. The one clamp that is used in the center position in this scenario is located between a person's legs where there is more room, rather than in a position above the person's thighs.

Another component that is attached to the keyboard surface are pegs (or in other instances an adjustable fence or plate) that holds the keyboard in place so that it does not slide off the back end of the keyboard surface when the keyboard is at a significantly steep angle for holding the keyboard in the standing or walking position. In addition, these pegs are adjustable so that they can be positioned as far forward or backward as needed to hold the keyboard forward on the surface at the desired distance from the front edge. As a result, the front of the keyboard can be positions to hold an optional standard ergonomic wrist pad if desired.

The keyboard system also has a rear fence along the back edge of the keyboard surface to further prevent anything from sliding off the back edge of the surface. Additional items, like a pencil and pen can be kept on the surface without sliding off the back edge. This fence has the additional feature that it has one or more slots to hold the cable (commonly a USB or PS2 cable) that is used to connect the keyboard with a computer. This keeps the cable neatly tucked away and holds it in place so it does not get tangled up with other components.

Another aspect of the system is an extension to the mounting frame and the addition of peripheral surfaces on the left and right sides of the keyboard surface. The frame would have similar rod, axle, or bar that extends to the sides of the frame (see illustrations). The key aspect of this is that this rod is at an angle to the keyboard axle. In an embodiment, the angle is, for example, 45 degrees. This angle may be optimized in other instances for the correct ergonomic positions. By these rods turning, for example, 45 degrees towards the user, the side surfaces are able to effectively be closer to the body of the person using the system. This reduces the distance that a person has to reach to the side a peripheral on the side surface such as a mouse or trackball. This allows a better ergonomic position to be achieved, by allowing the user to use their pointing device (e.g., mouse, trackball, trackpad, or other device) without any pronation, supination, flexion, or extension of the wrists.

Additionally, the side surface mounts to the axle with a mechanism similar to that described above for the keyboard platform, allowing any angle of incline of the surface to be achieved. Another important part of this invention is that this adjustment is completely independent of the adjustment of the angle of the keyboard surface. As a result, these angles can be optimized for the desired ergonomics independently of the keyboard angle and of each other. Adjusting one does not require the user to re-adjust the other. Existing keyboard positioning systems do not have independent adjustments that do not affect each other. When an adjustment is made to the keyboard angle, the existing systems adjust the peripheral surface angle as well since the two are tied together.

Similar to the keyboard surface, the peripheral surface has a rear fence on the back edges of the surface to keep items from rolling off the back edge. It also has slots in the back fence to allow for cable management to keep cables neat and from getting tangled up.

The peripheral surface also has movable pegs (or fences or plates) for keeping a mouse or trackball at the appropriate position on the surface. In the case of a mouse (or similar other pointing devices), which a person is moving relative to the surface, when a person lets go of the mouse, they do not want it to slide all the way to the back edge of the surface (or off the back of there was no back fence either). If it did, then they would have to reach further away to resume using the device. So the pegs are able to be positioned on the surface to allow the mouse to slide only a short distance away from the primary mousing area. In the case of a trackball, the user can position the pegs so the trackball is as close to the front edge of the peripheral surface as a person would want it, as to minimize how far a person would have to reach forward, thus allowing for a better ergonomic adjustment.

An additional variation of this invention is that the keyboard surface and axle mounting bar are mounted inside the outer dimensions of a desktop surface in an area cut out from the desktop. In addition to all the benefits of the keyboard mounting system previously described, this brings the overall center of gravity closer to the center of the desk, resulting in less movement of the desktop when forces are exerted on the keyboard positioning system. Also, the shape of the cutout has angled edges (the omega shape), which allow for the person's body to easily get closer to the table and reach a mouse or trackball in those locations on the table.

Additionally, in those locations, there would be an optional individually positionable platform at preset or adjustable angles that would be made up of the peripheral surface with adjustable pegs and rear fences. These platforms could be independent from the desktop or integrated with the desktop.

This disclosure comprises at least the following:

An angle adjustable surface that securely holds any commonly used computer keyboards.

An ergonomically optimum fixed angle surface for above purpose.

Additional surfaces on either side of the keyboard surface for proper positioning of peripheral devices, such as mouse controllers or track-ball devices, whether wire-tethered or wireless. Such surfaces are hinged in line with the front of the keyboard so that they may be set to a level position (for using a mouse) when the keyboard is tilted up.

Surfaces for peripheral devices described above that are independently adjustable for optimum positioning and for keeping these devices from sliding off the platform at steep angles.

Surfaces such as the above that are fixed.

Keyboard and peripheral device surfaces, as noted above, that are placed upon or attached to any of the typically available desk surfaces used for working while walking on exercise treadmills.

Keyboard and peripheral device surfaces, as noted above, that are integrated into a desk used for working while walking on exercise treadmills.

Keyboard and peripheral device surfaces, as noted above, that are integrated into a device composed of an integral treadmill/work surface.

Provision for securing the keyboard and/or peripheral devices to the above-mentioned surfaces and/or devices, including, but not limited to, positionable "backstop" raised fences or pegs, high friction materials attached to either the surfaces or keyboard/peripheral devices.

Provision for the integration or application of any materials used for resting the hands/wrists either for keyboarding or peripheral device use.

Provision for integrating adjustability and/or features noted above into the keyboard itself or the peripheral devices.

Mounting frame that allows for quick and easy mounting and dismounting of the system.

Mounting frame that avoids obstructions on the front edge of a desktop surface, such as a structural frame component of the desk, a drawer, etc.

Any reference in the description comprising an element number, without a subelement identifier when a subelement identifier exists in the figures, when used in the plural, is intended to reference any two or more elements with a like element number. When such a reference is made in the singular form, it is intended to reference one of the elements with the like element number without limitation to a specific one of the elements. Any explicit usage herein to the contrary or providing further qualification or identification shall take precedence.

Each of the figures provided comprise varying elements and associated descriptions. For avoidance of redundancy, elements may be illustrated in a particular figure but not identified by reference number or described with respect to the particular figure. However, such elements are indentified and described with respect to other figures provided. For the avoidance of unnecessarily complicating the figures, certain well-known elements (e.g., screws, bolts, etc.) may be illustrated without associated element numbers or description.

Figure 1B:
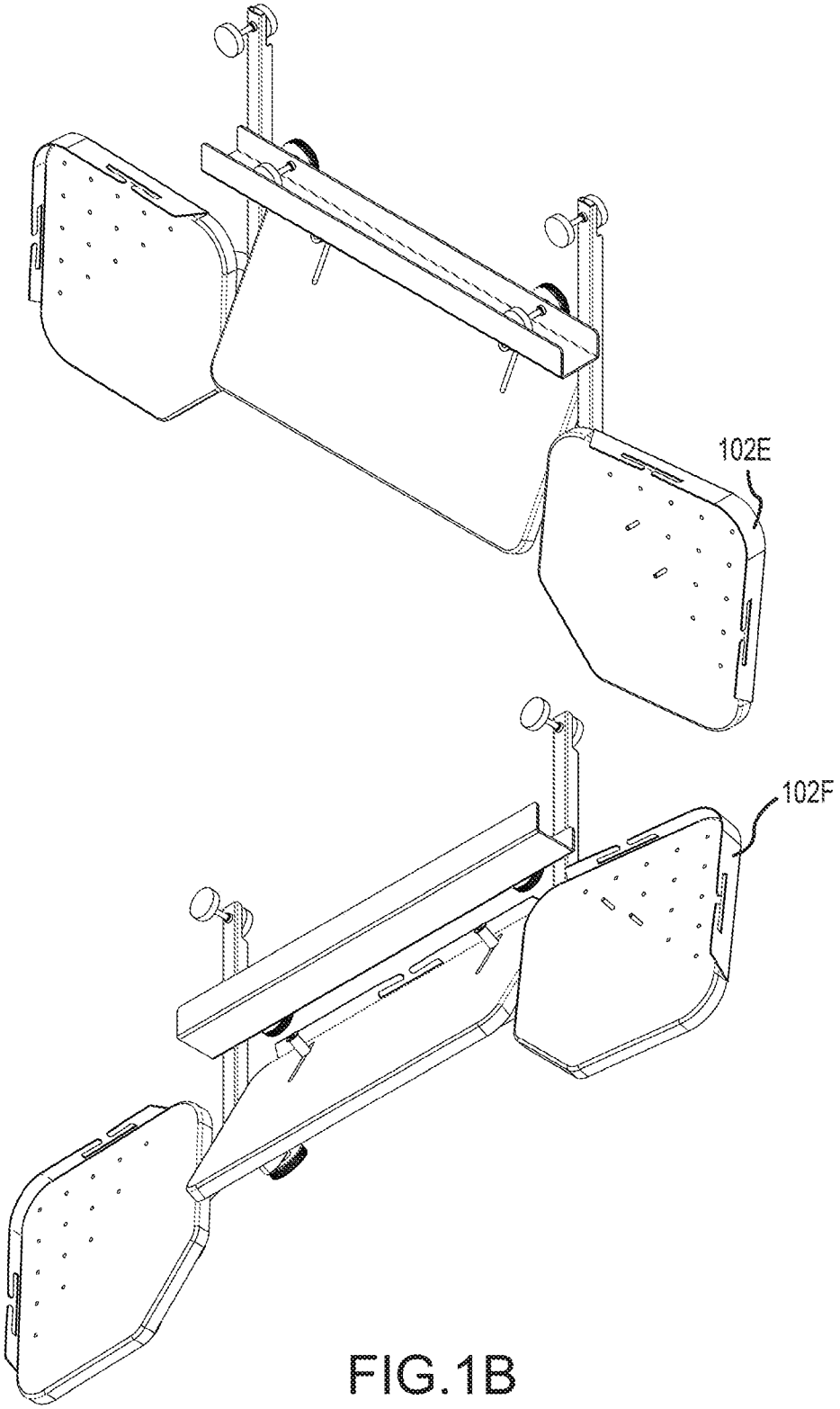

FIGS. 1A-1B illustrate multiple graphical projections of an embodiment of the keyboard and peripheral mounting system (or simply, "system") 102. In one embodiment, system 102A illustrates a front view, system 102B illustrates a side view, system 102C illustrates a top view, system 102D illustrates a bottom view, system 102E illustrates a right-distal top view, and system 102F illustrates a right-proximate top view.

Figure 2:
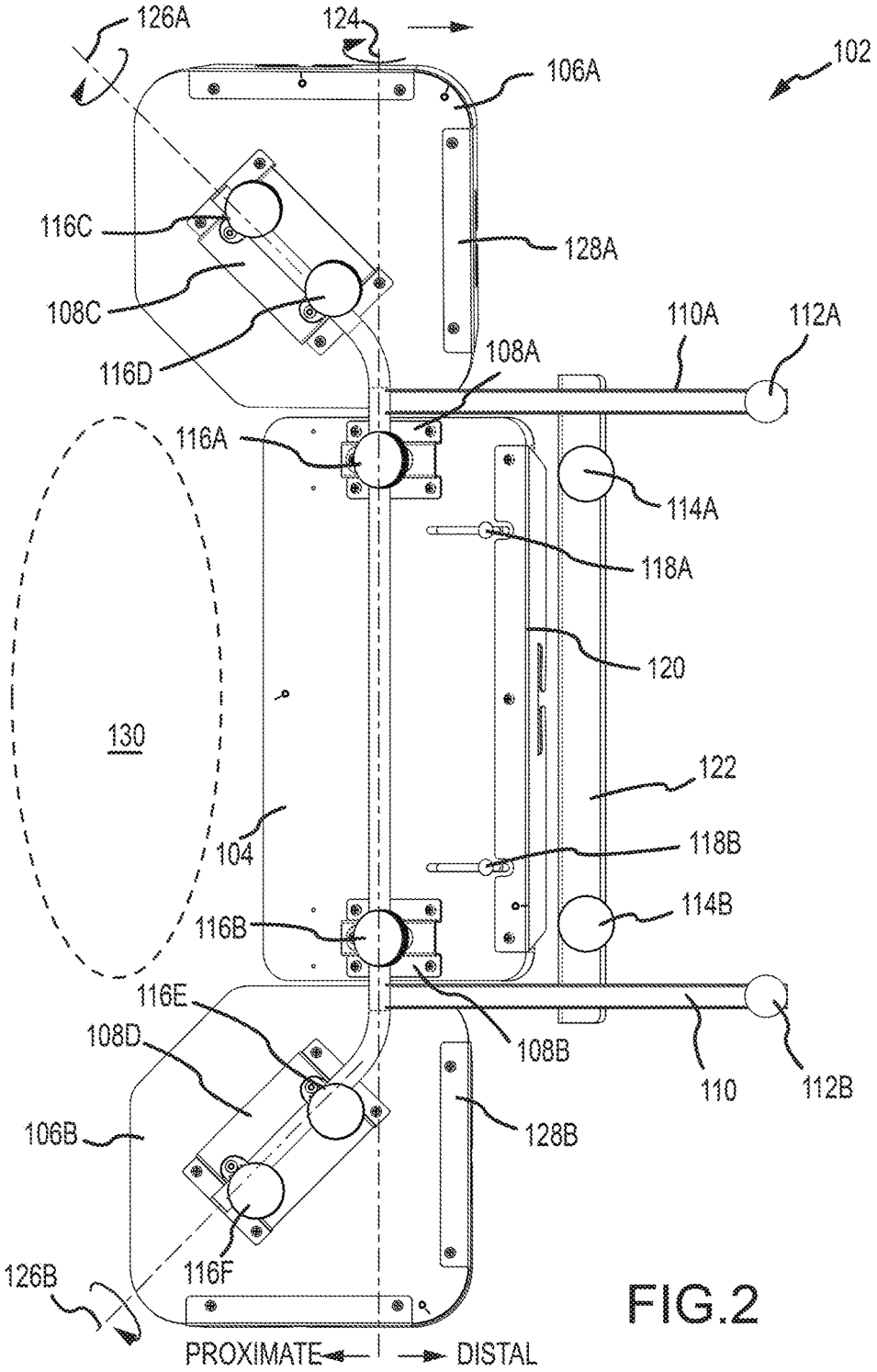
FIG. 2 illustrates one of the graphical projections of FIG. 1 with greater detail.

FIG. 2 illustrates one of the graphical projections of FIG. 1, with greater detail. More specifically, a bottom view of system 102D is shown in FIG. 2. Frame 110 is provided for engaging surfaces of a table, desk, or similar work surface for supporting the system. Frame 110 incorporates distally extending arms and a lateral member (see, for example, FIG. 22) for accommodating clamps 108A-B and keyboard support 104. In one embodiment, keyboard support 104, by adjusting clamps 108A-B via knobs 116A-B, may be rotated on axis 124 to provide a continuous range of rotational positions of keyboard support 104. In another embodiment, frame 110 may incorporate a number of laterally extending peripheral support members (see, for example, FIG. 22) for engaging peripheral clamp 108C to support peripheral support 106A, and/or peripheral clamp 108D to support peripheral support 106B. Peripheral clamps 108C and/or 108D may be adjustable, such as by one or more of knobs 116C-F, to allow rotation of peripheral support 106A and/or 106B along their respective peripheral support members 106A and/or 106B on axis 126A and/or 126B. To maintain close proximity to user-area 130, peripheral support members 106A and/or 106B of frame 110 may be at an angle, such as 45 degrees, from a lateral portion and towards user-area 130.

Keyboard support 104 may comprise a number of keyboard retaining elements to restrict movement of a keyboard or other item placed on a keyboard support surface (see, FIG. 3) of keyboard support 104. In one embodiment, rear fence 120 is attached to the distal edge of keyboard support 104. In another embodiment, one or more pegs, such as pegs 118A-B may be adjustably positioned on keyboard support 104. Similarly, one or more fences 128A-B may be provided to restrain objects placed on a peripheral support surface (see FIG. 3) of peripheral support 106A and/or 106B.

As presented and described above, frame 110 is provided to engage keyboard support 104 and optionally one or more of peripheral supports 106 via clamps 108. In another embodiment, frame 110 provides pads 112A-B distally located on arms of frame 110. In another embodiment, pads 114A-B are provided to engage the desk or other work surface, such as to provide a secure and/or non-marring point of contact on the work surface. As a further option, one or more of pads 112 and/or 114 may be threaded to facilitate adjustment of the engagement force provided to the work surface.

In another embodiment, keyboard support 104 is rotationally supported on a portion of frame 110 (see, FIG. 22, ref 2206) to rotate on axis 124 substantially midway between the distal and proximate limits of keyboard support 104 and provide a fulcrum for keyboard support 104 attached thereto. As a benefit, a user utilizing a keyboard place on keyboard support 104 provides downward force (e.g., the act of typing on keys of the keyboard) that is, or is substantially in line with frame 110 and, therefore, keyboard support 104 is able to provide greater resistance to unwanted motion, such as shaking that may otherwise result from the act of typing on a keyboard.

Figure 3:
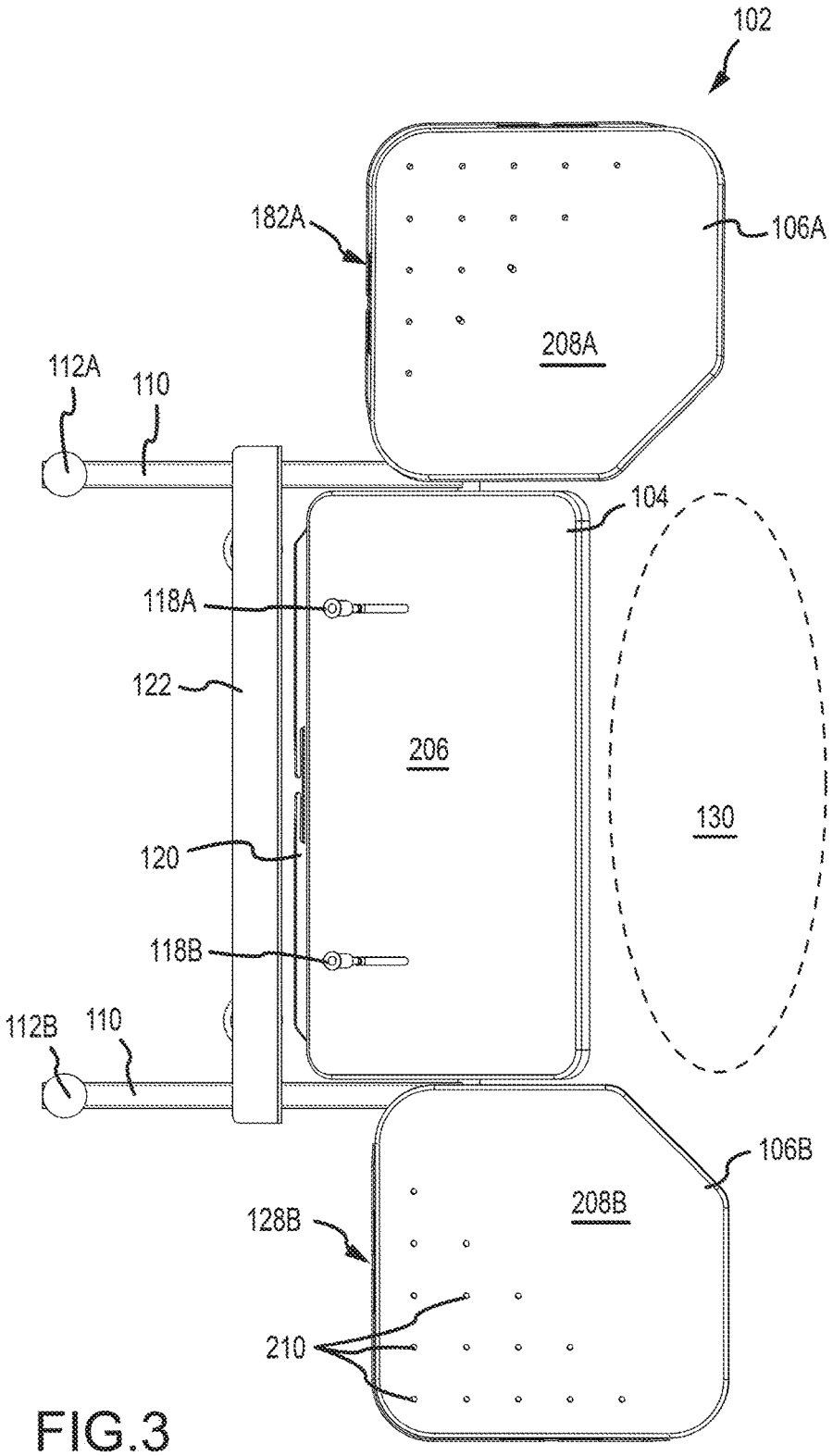
FIG. 3 illustrates one of the graphical projections of FIG. 1 with greater detail.

FIG. 3 illustrates one of the graphical projections of FIG. 1 with greater detail. More specifically, a top view of system 102C is shown in FIG. 2. System 102 illustrates keyboard surface 206 of keyboard support 104, such as to support a keyboard for use when placed thereon. Optionally, one or more peripheral supports 106A and/or 106B are provided with peripheral support surfaces 208A and/or 208B, such as to support a periphery device (e.g., mouse, trackball, 10-key, etc.) for use when placed thereon.

Pegs 118A and/or 118B may be provided to restrain a keyboard when keyboard support 104 is angled away from user area 130. Optionally, rear fence 120 may be attached to the distal end of keyboard support 104 to restrain a keyboard or other item placed on keyboard support surface 206. Similarly, one or more peg holes 210 may be provided to accommodate peripheral restrain pegs (not shown). Optionally, peripheral fence 128A and/or 128B may be provided on the distal end of peripheral support 106A and/or 106B, respectively, to restrain an item placed thereon.

Figure 4:
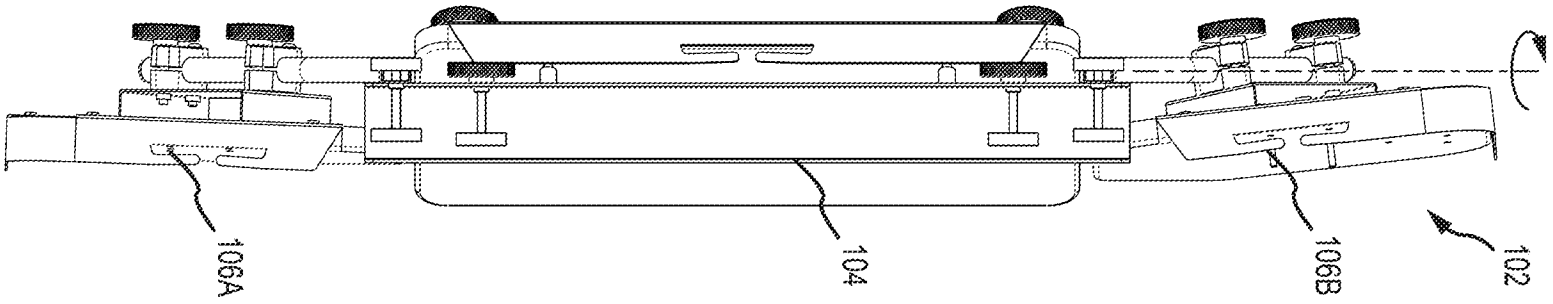
FIG. 4 illustrates one of the graphical projections of FIG. 1 with greater detail.

FIG. 4 illustrates one of the graphical projections of FIG. 1 with greater detail. More specifically, a rear view of system 102 is shown in FIG. 4. Keyboard support 104 and peripheral supports 106 are illustrated.

Figure 5:
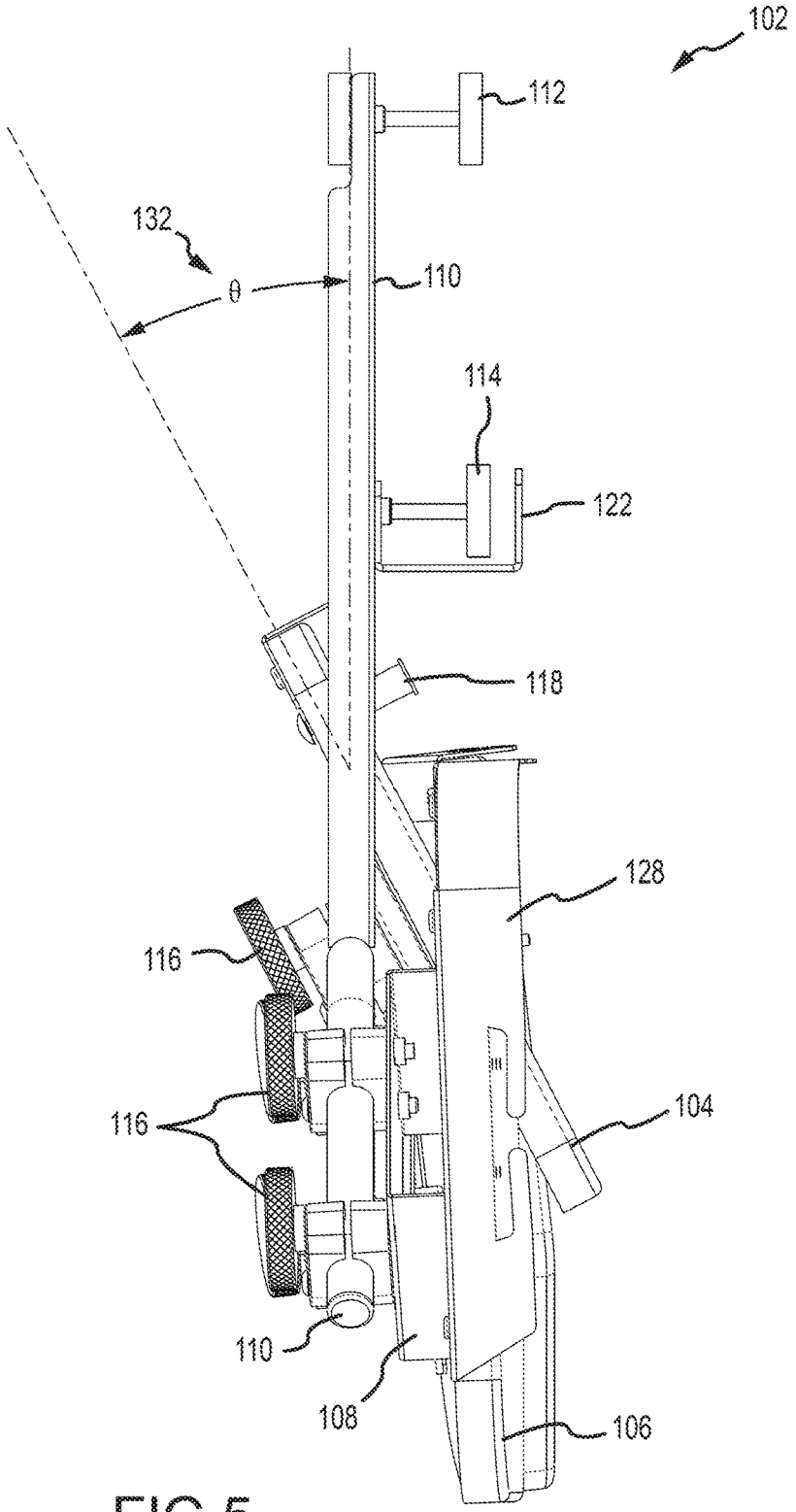
FIG. 5 illustrates one of the graphical projections of FIG. 1 with greater detail.

FIG. 5 illustrates one of the graphical projections of FIG. 1 with greater detail. More specifically, a side view of system 102B is shown in FIG. 5. System 102B, as illustrated in FIG. 5, has keyboard support 104 rotated to angle theta ("θ") 132. For example, knob 116 associated with keyboard support 104 may be initially loosened to facilitate rotation of keyboard support 104 on frame 110. Once at a desired angle theta 132, knob 116 may be retightened to securely resist any additional or unintended rotation of keyboard support 104.

In another embodiment, elements supporting the clamping of system 102 to a work surface are provided. Pad 112, pad 114, and lip 122 are provided to securely engage a work surface, such as a desktop or table. Peg(s) 118 is provided to resist distal motion of a keyboard placed on keyboard support 102 and peripheral support 106 is optionally provided. The rotational position of peripheral support 106 may be provided by friction between frame 110 and clamp 108 as determined by knobs 116.

Figure 6A:
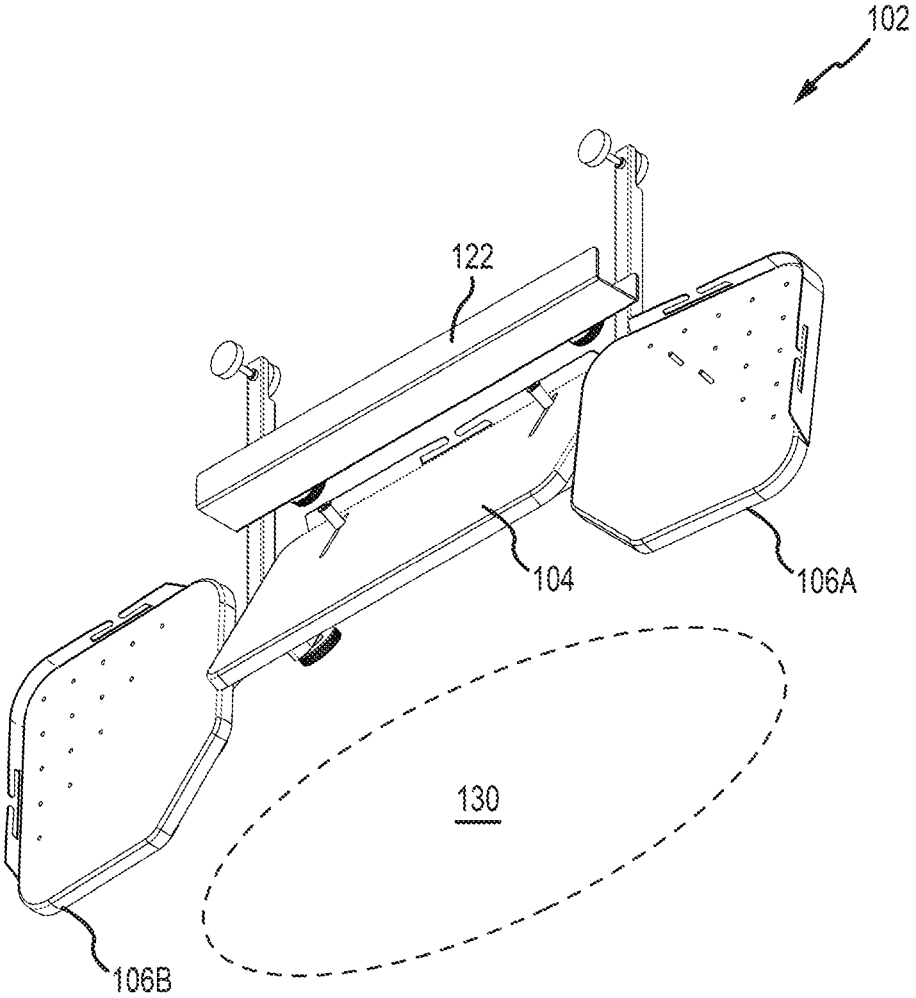
FIGS. 6A-6B illustrate two of the graphical projections of FIG. 1 with greater detail.
Figure 6B:
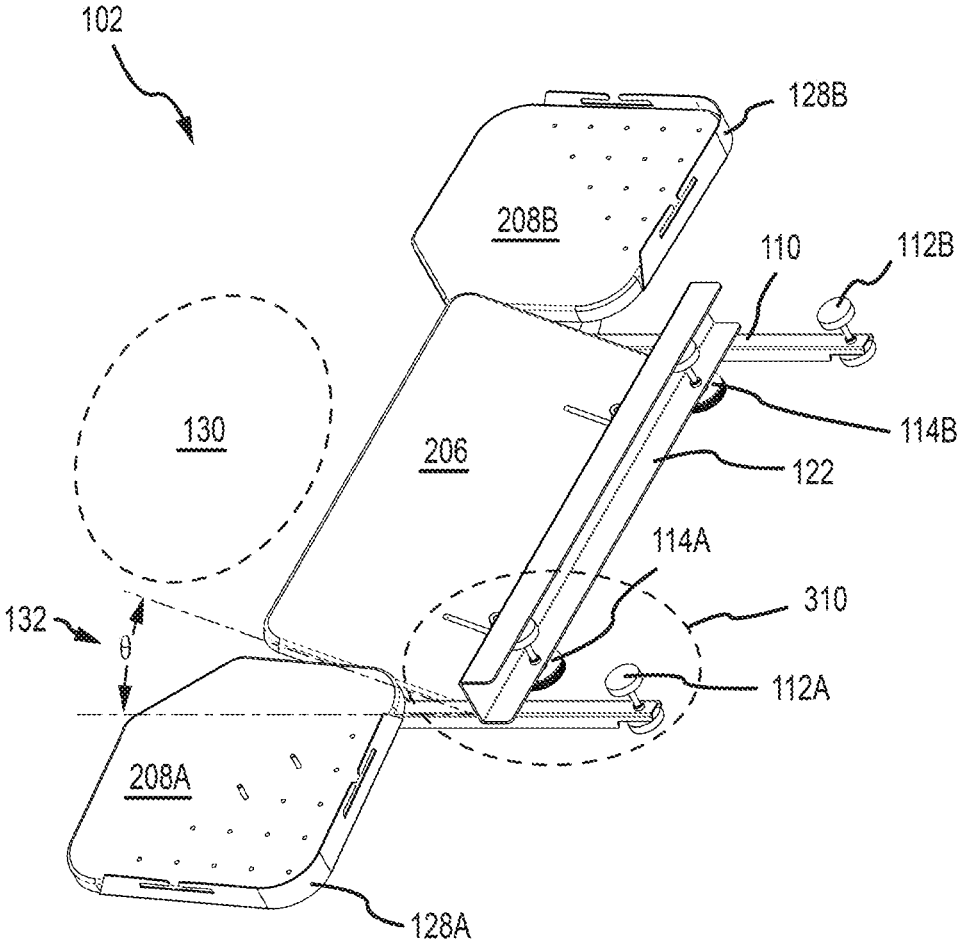

FIGS. 6A-6B illustrates two of the graphical projections of FIG. 1 with greater detail. More specifically, a first isometric view of system 102 is shown in FIG. 6A and a second isometric view is shown in FIG. 6B. Peripheral supports 106 are illustrated in a substantially planar configuration with keyboard support 104 angled away from user area 130 at angle theta 132. As a result, peripheral support surfaces 208 and keyboard support surface 206 are provided and independently determined angles relative to the plane (such as being co-planar with arms of frame 110.

In another embodiment, system clamp 310 is formed by the arrangement of frame 110, and pad 112A, operable to apply a force to the underside of a work surface, and lip 122, and pad 114A operable to apply a counteracting force and/or other forces via engagement with the work surface. In another embodiment, system clamp 310 may comprise components such as pad 112B and/or 114B. Fence(s) 128 are illustrated showing openings, such as to accommodate and manage cables associated with peripheral devices placed upon peripheral surface(s) 208.

Figure 7A:
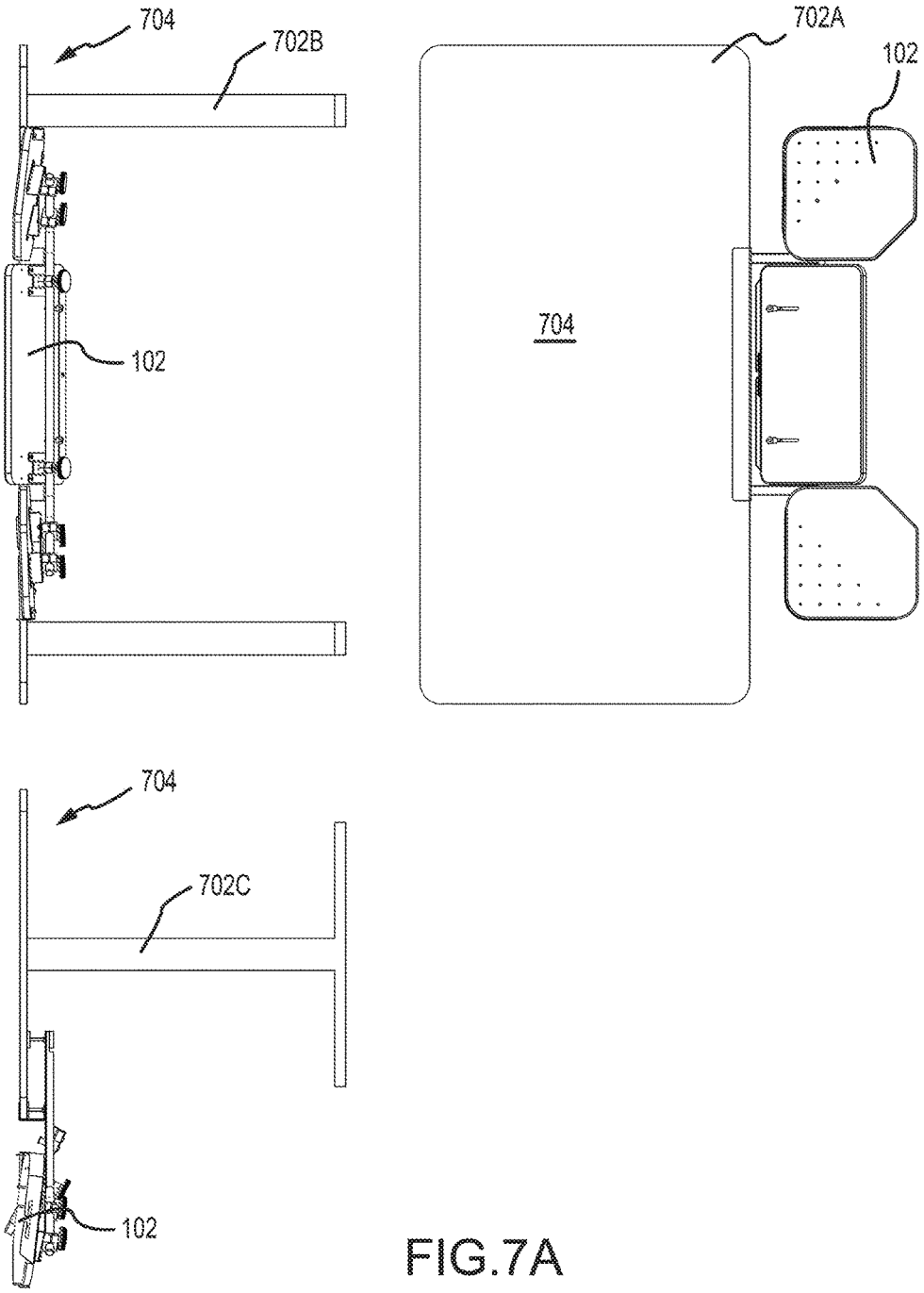
FIGS. 7A-7B illustrate an embodiment of a keyboard and peripheral mounting system connected to a table.
Figure 7B:
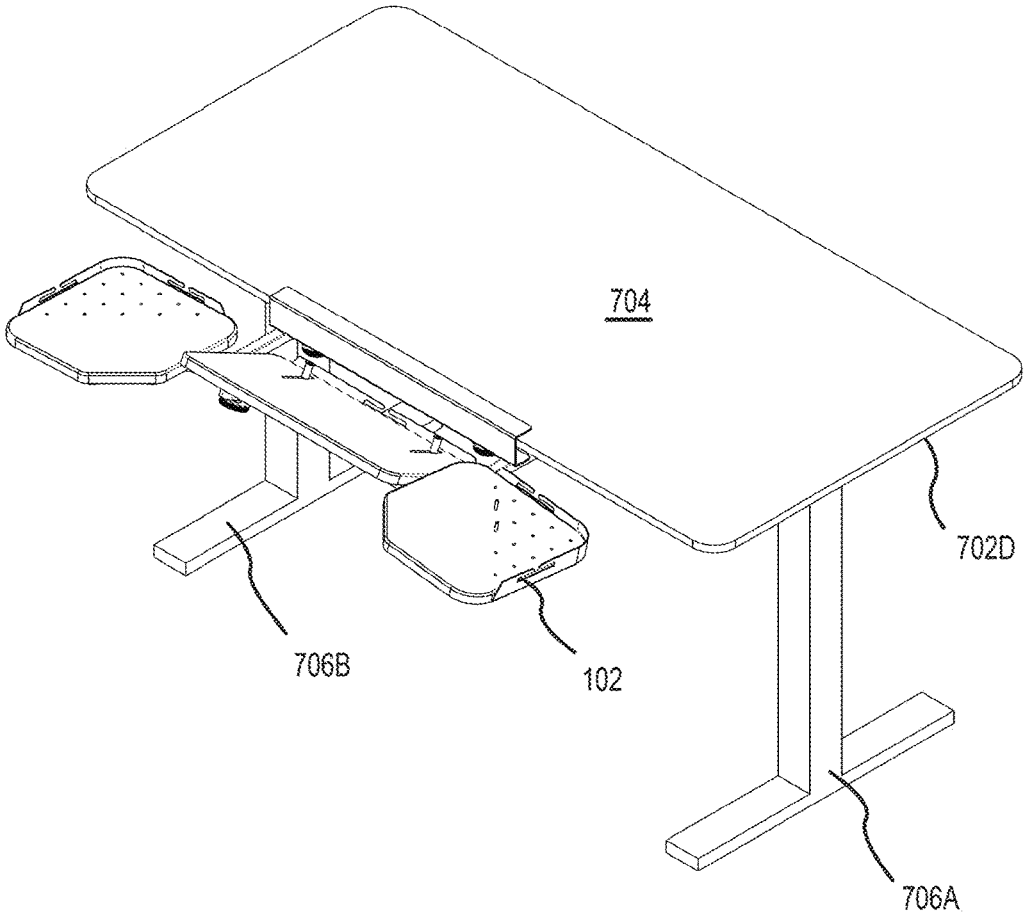

FIGS. 7A-B illustrate an embodiment of system 102 connected to a table 704. Table 702A is a top view, table 702B is a front view, table 702C is a side view, and table 702D is an isometric view each within attached system 102. Table 704 may comprise supports, such as legs 706A-706B, such as to present system 102 at a height associated with a user in a standing and/or walking configuration.

Figure 8A:
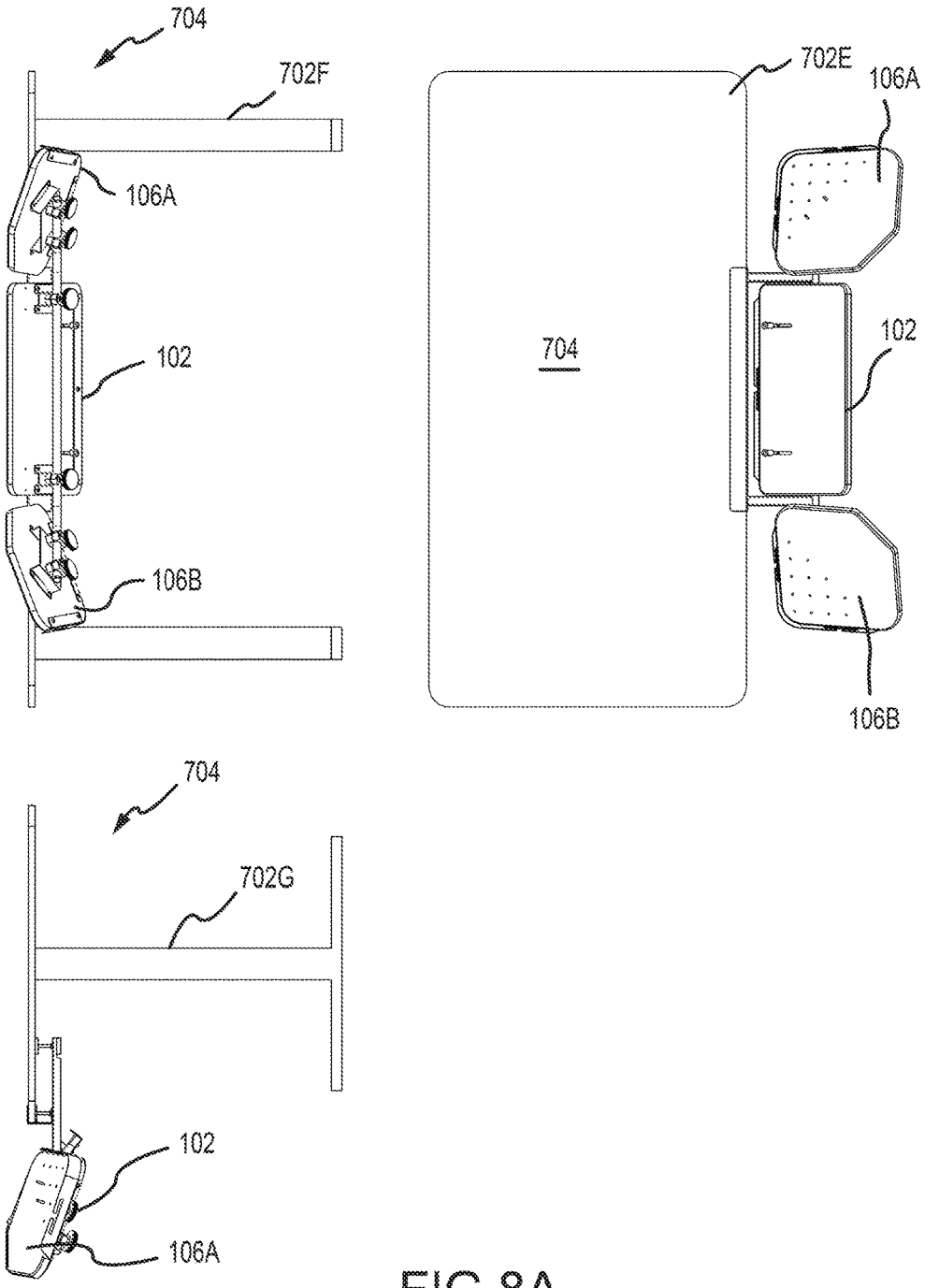
FIGS. 8A-8B illustrate an embodiment of a keyboard and peripheral mounting system connected to a table.
Figure 8B:
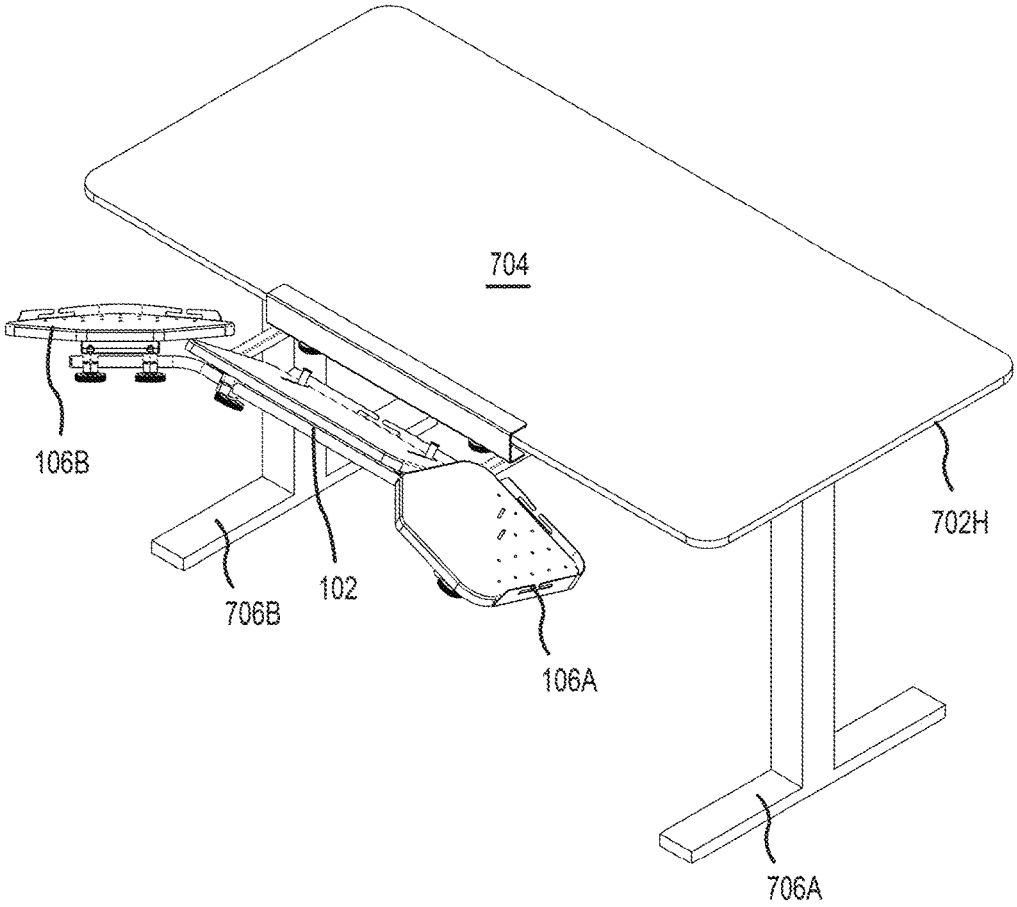

FIGS. 8A-B illustrate an embodiment of system 102 connected to a table 704. Table 702E is a top view, table 702F is a front view, table 702G is a side view, and table 702H is an isometric view each within attached system 102. Table 704 may comprise supports, such as legs 706A-706B, such as to present system 102 at a height associated with a user in a standing and/or walking configuration. FIGS. 8A-B illustrate peripheral supports 106A-B positioned to be non-planar with table 704 or keyboard support 102, such as tilted away from a user area (not shown) and peripheral support 106A is positioned at an angle different from peripheral support 106B.

Figure 9A:
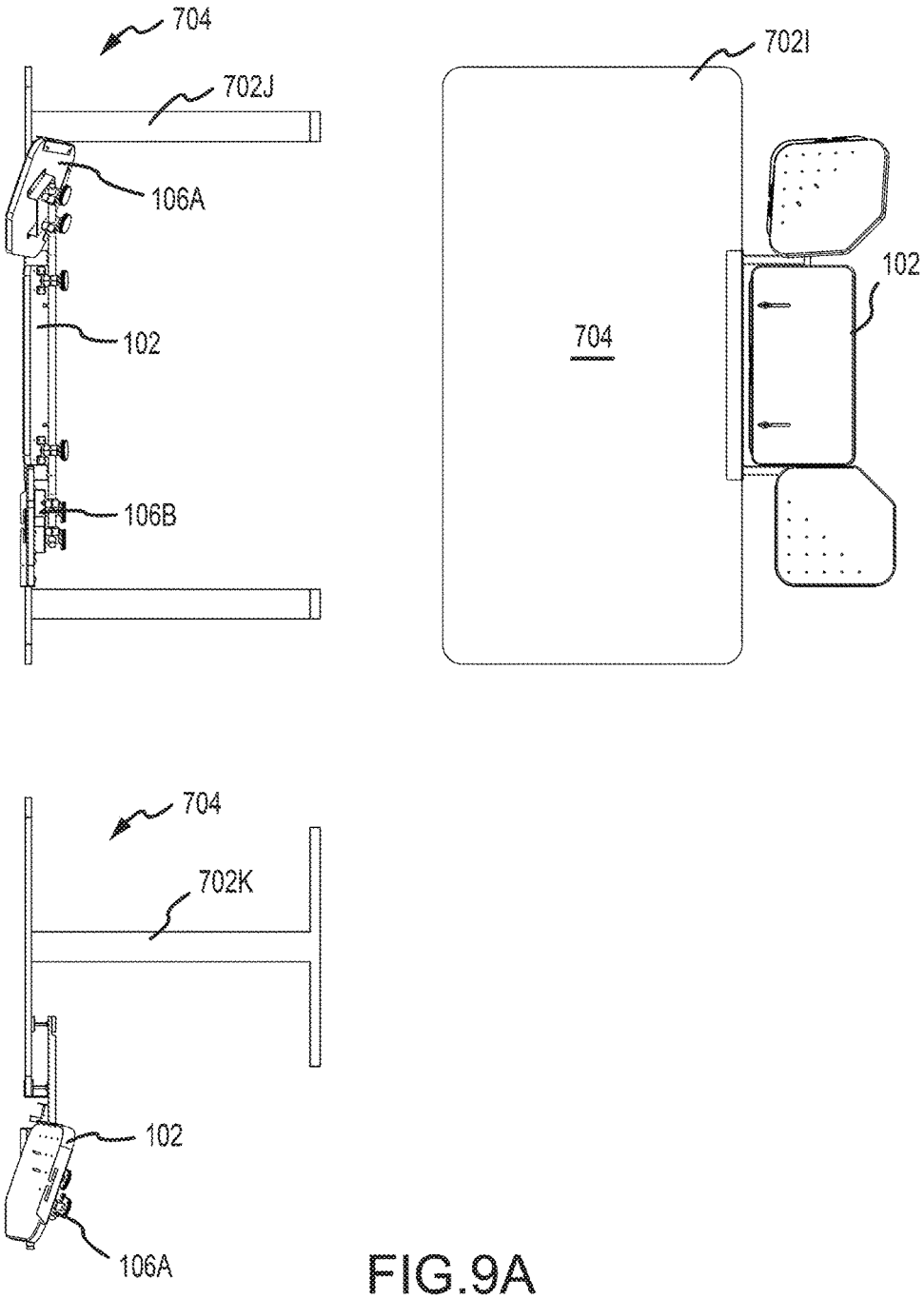
FIGS. 9A-9B illustrate an embodiment of a keyboard and peripheral mounting system connected to a table.
Figure 9B:
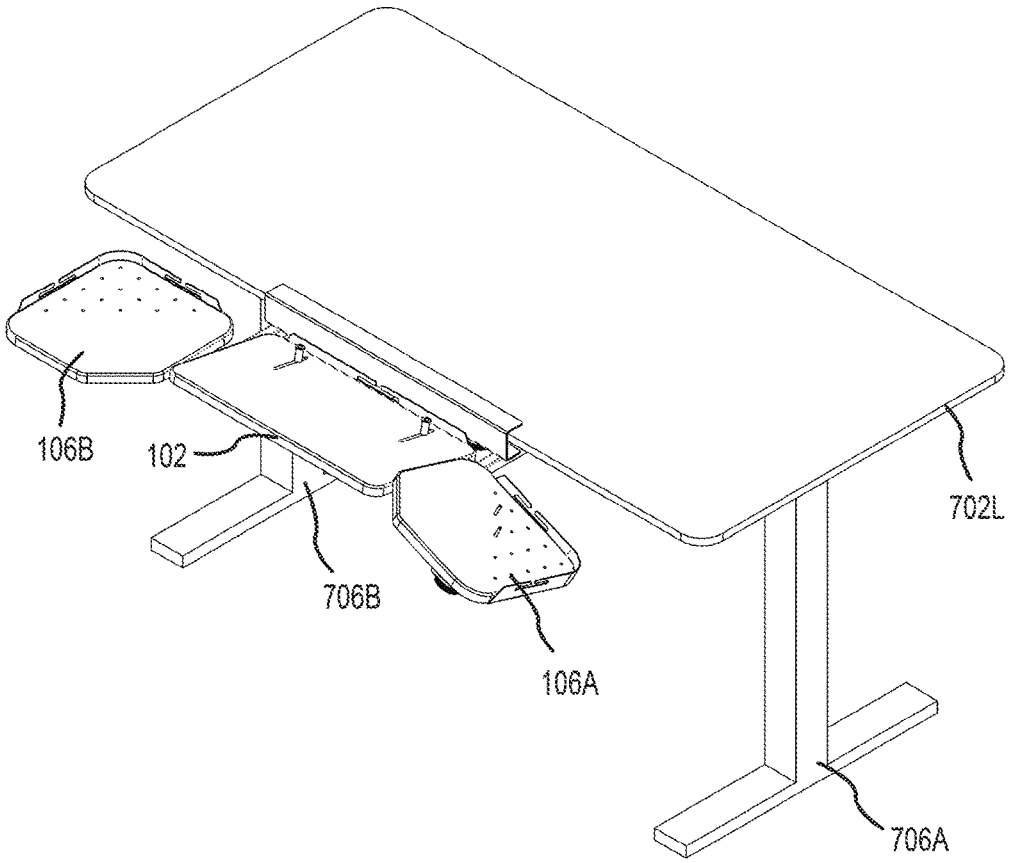

FIGS. 9A-B illustrate an embodiment of system 102 connected to a table 704. Table 702*i* is a top view, table 702J is a front view, table 702K is a side view, and table 702L is an isometric view each within attached system 102. Table 704 may comprise supports, such as legs 706A-706B, such as to present system 102 at a height associated with a user in a standing and/or walking configuration. FIGS. 9A-B illustrate peripheral supports 106A-B positioned to be non-planar with table 704 or keyboard support 102, such as tilted away from a user area (not shown).

Figure 10A:
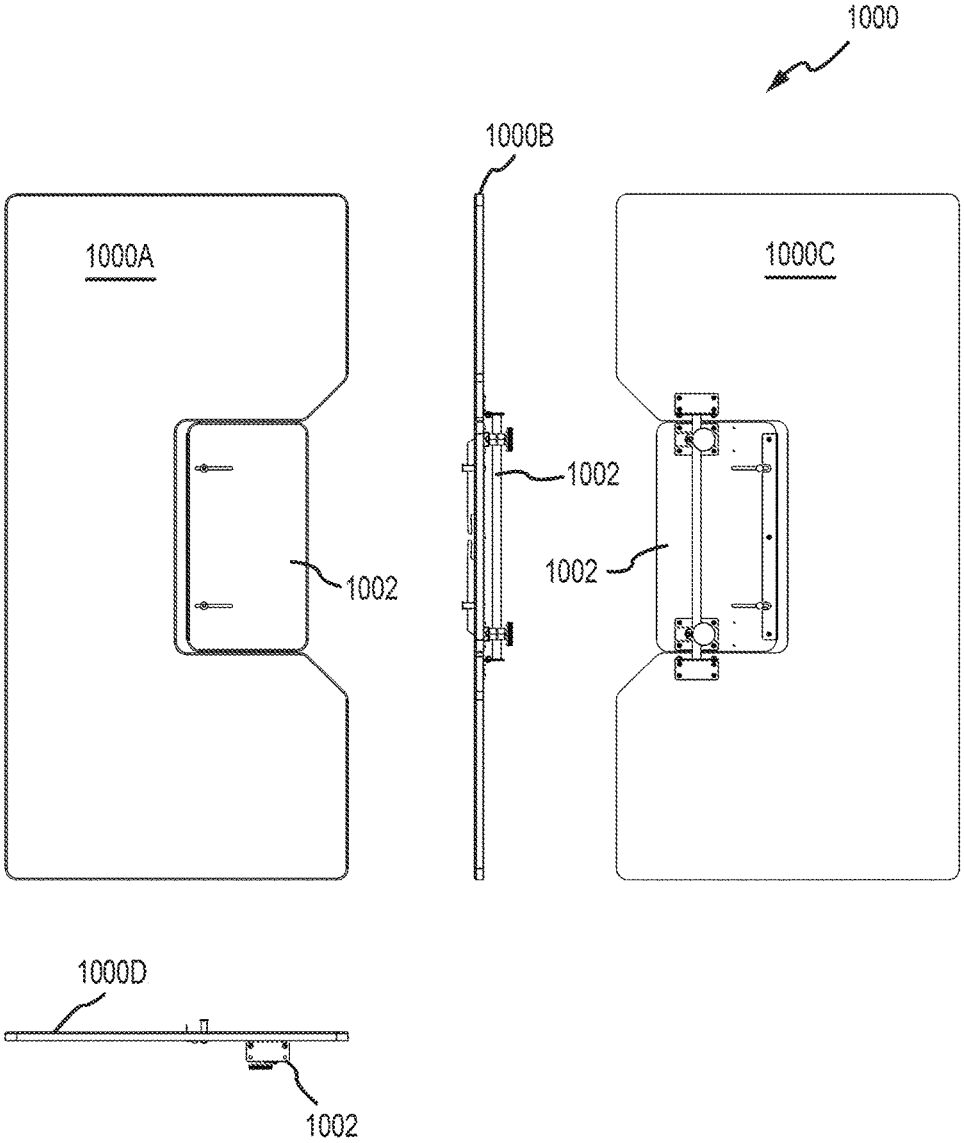
FIGS. 10A-10B illustrate multiple graphical projections of an embodiment of a keyboard mounting system connected to a table, wherein the table has a cutout to accommodate the keyboard mounting system.
Figure 10B:
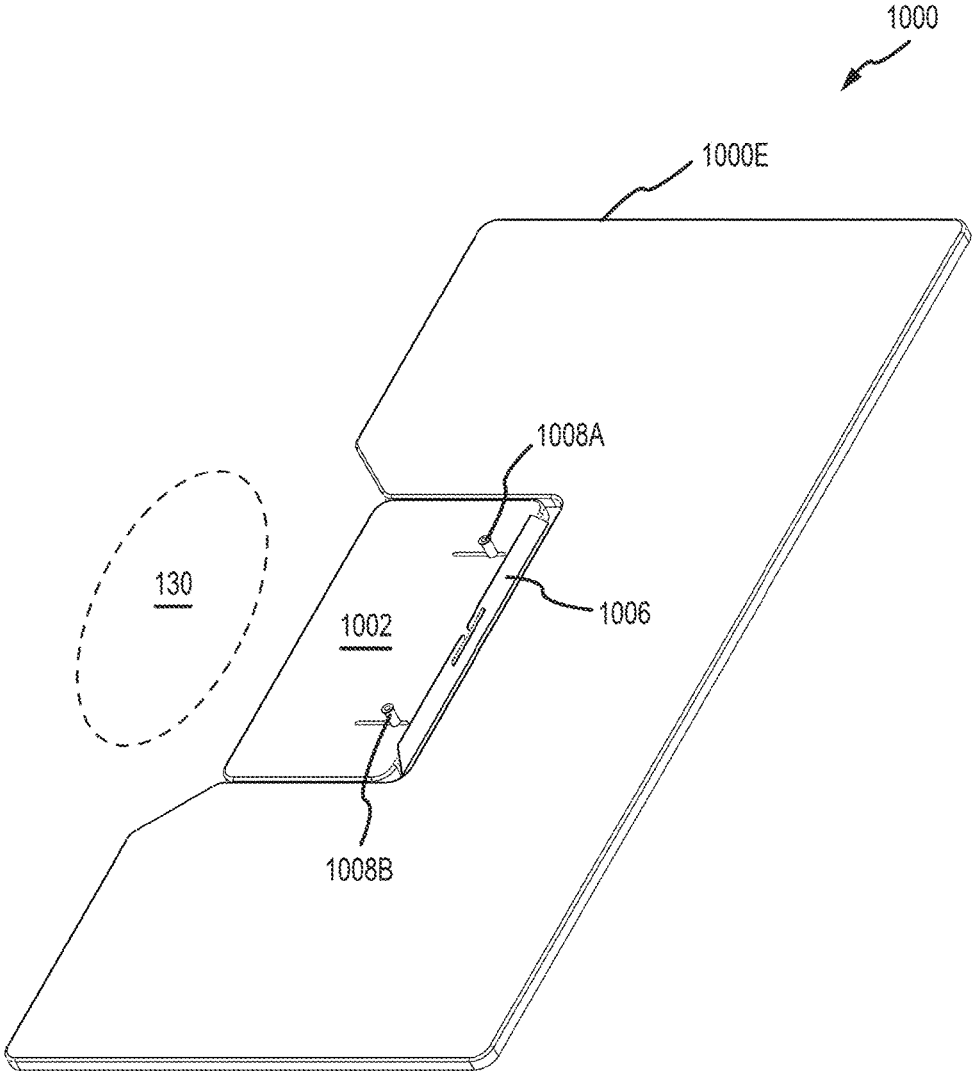

FIGS. 10A-B illustrate multiple graphical projections of an embodiment of system 102 connected to table 1000, wherein table 1000 has a cutout to accommodate the keyboard mounting system. Table 1000A is a top view, table 1000B is a front view, table 1000C is a bottom view, and table 1000D is an isometric view, each is within attached system 1002. Table 1000 may be provided with supports, such as legs, to present system 1002 at a height associated with a user in a standing and/or walking configuration located in user-area 130. A keyboard placed on system 1002 may be restrained by one or more of peg(s) 1008A-B and/or rear fence 1006 located at the distal portion of system 1002.

Figure 11:
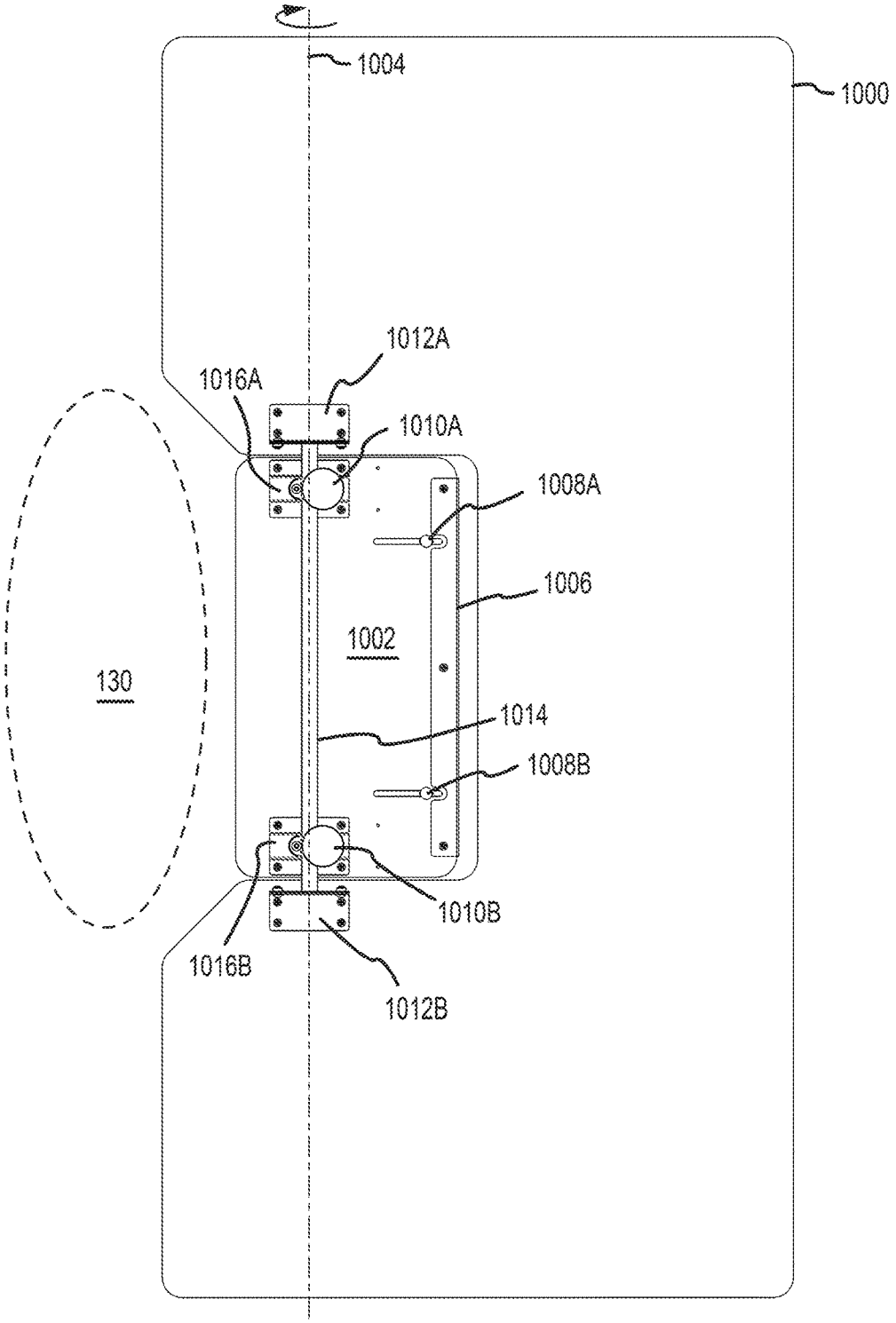
FIG. 11 illustrates one of the graphical projections of FIGS. 10A-10B with greater detail.

FIG. 11 illustrates one of the graphical projections of FIG. 10 with greater detail. In one embodiment, system 1002 is attached to frame 1014 to rotate thereon along axis 1004. Attachment may be via clamp(s) 1016A and/or 1016B having knobs 1010A and/or 1010B, respectively. Knobs 1010 allow a selective engagement force upon frame 1014 to selectively rotate and maintain an angle of pitch for system 1002. Fence 1006 and/or at least one of pegs 1008A and/or 1008B may restrain a keyboard or similar item when system 1002 is pitched away from user-area 130. Frame 1014 may be attached to table 1000 via brackets 1012A and/or 1012B.

Figure 12:
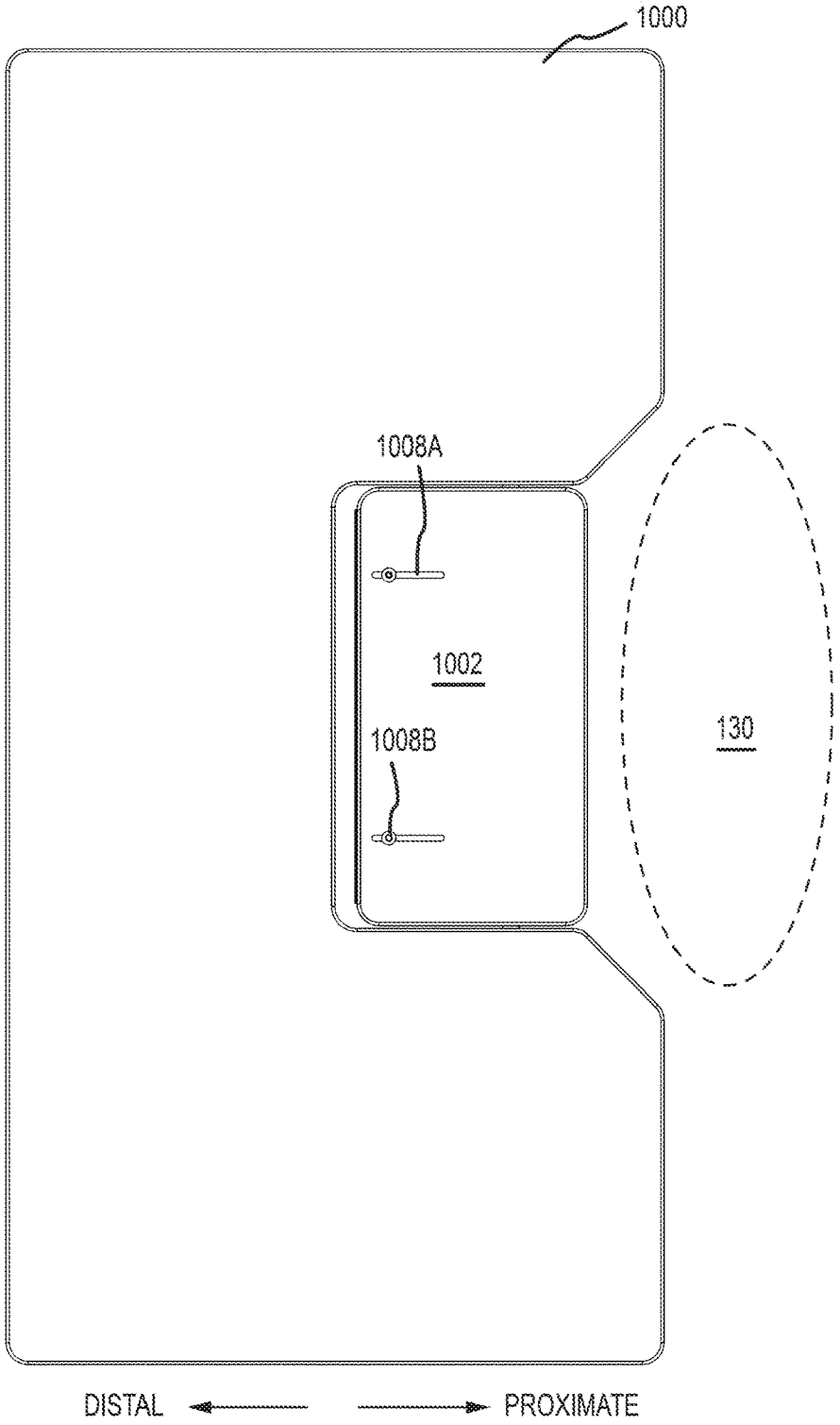
FIG. 12 illustrates one of the graphical projections of FIG. 10 with greater detail.

FIG. 12 illustrates one of the graphical projections of FIG. 10 with greater detail. In one embodiment, system 1002 is provided with pegs 1008A-B on a distal portion of system 1002 and away from user-area 130.

Figure 13:
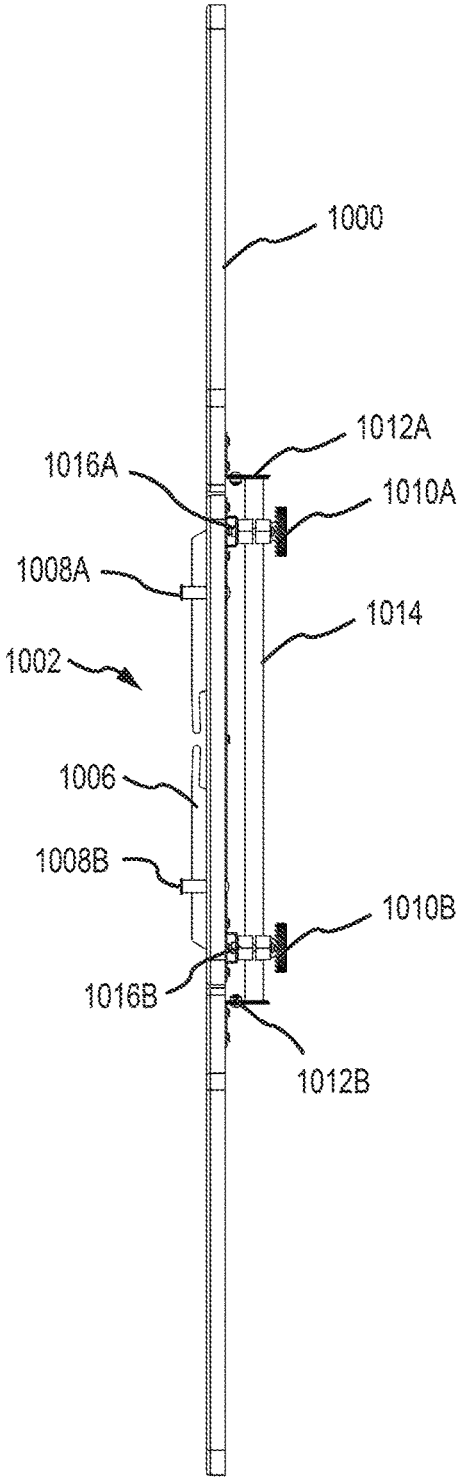
FIG. 13 illustrates one of the graphical projections of FIG. 10 with greater detail.

FIG. 13 illustrates one of the graphical projections of FIG. 10, with greater detail. FIG. 13 illustrates a front view of system 1002 attached to table 1000 in a planar configuration. System 1002 engages frame 1014 with clamps 1016 having a force determined by knob(s) 1010A-B. Frame 1014 may be affixed to brackets 1012, which, in turn, may be attached to table 1000. Fence 1006 and pegs 1008 are provided, such as to restrain an item, such as a keyboard, placed on system 1002.

Figure 14:
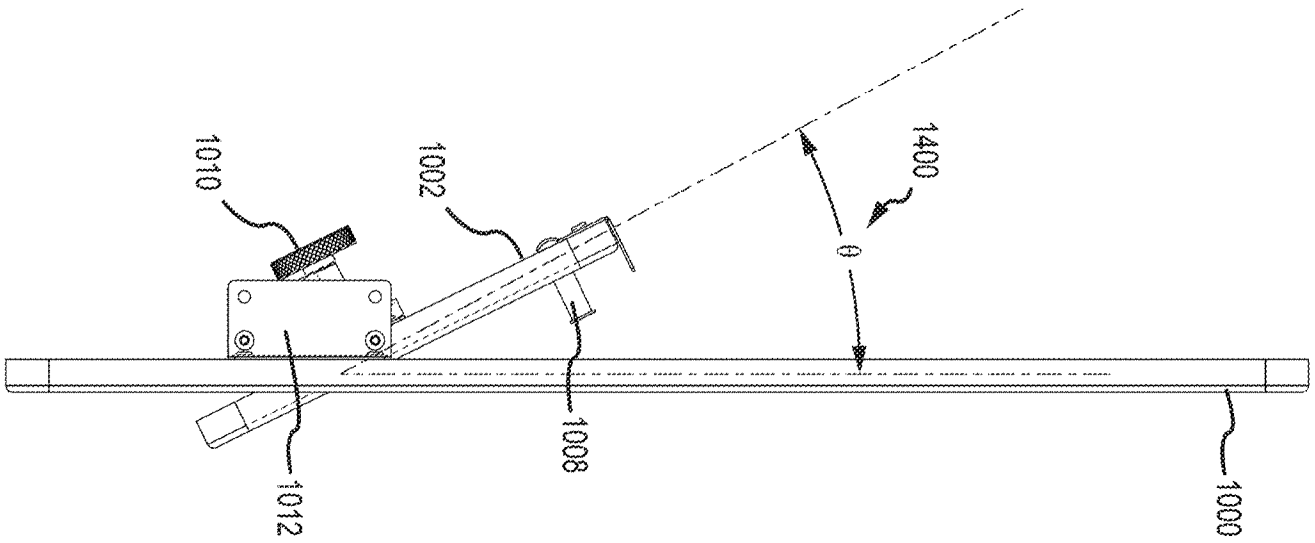
FIG. 14 illustrates one of the graphical projections of FIG. 10 with greater detail.

FIG. 14 illustrates one of the graphical projections of FIG. 10 with greater detail. FIG. 14 illustrates a side view of system 1002 attached to table 1000 in a non-planar configuration, specifically, angle theta 1400. System 1002 engages frame (not shown) with clamps (not shown) having a force determined, at least in part, by knob(s) 1010. Frame 1014 (not shown) may be affixed to brackets 1012, which, in turn, may be attached to table 1000. Pegs 1008 may be provided, such as to restrain an item, such as a keyboard, placed on system 1002.

Figure 15:
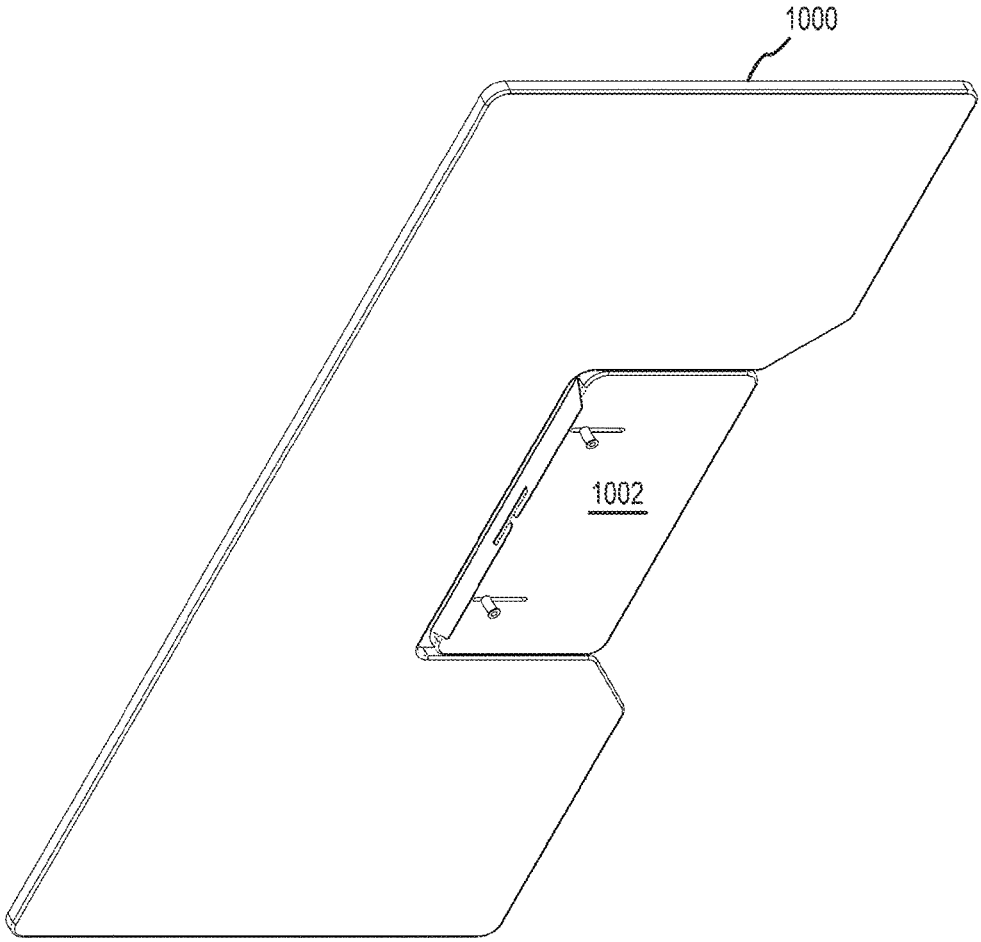
FIG. 15 illustrates one of the graphical projections of FIG. 10 with greater detail.

FIG. 15 illustrates one of the graphical projections of FIG. 10, with greater detail. FIG. 15 illustrates an isometric view of table 1000 with system 1002 therewith and configured to be substantially co-planar.

Figure 16A:
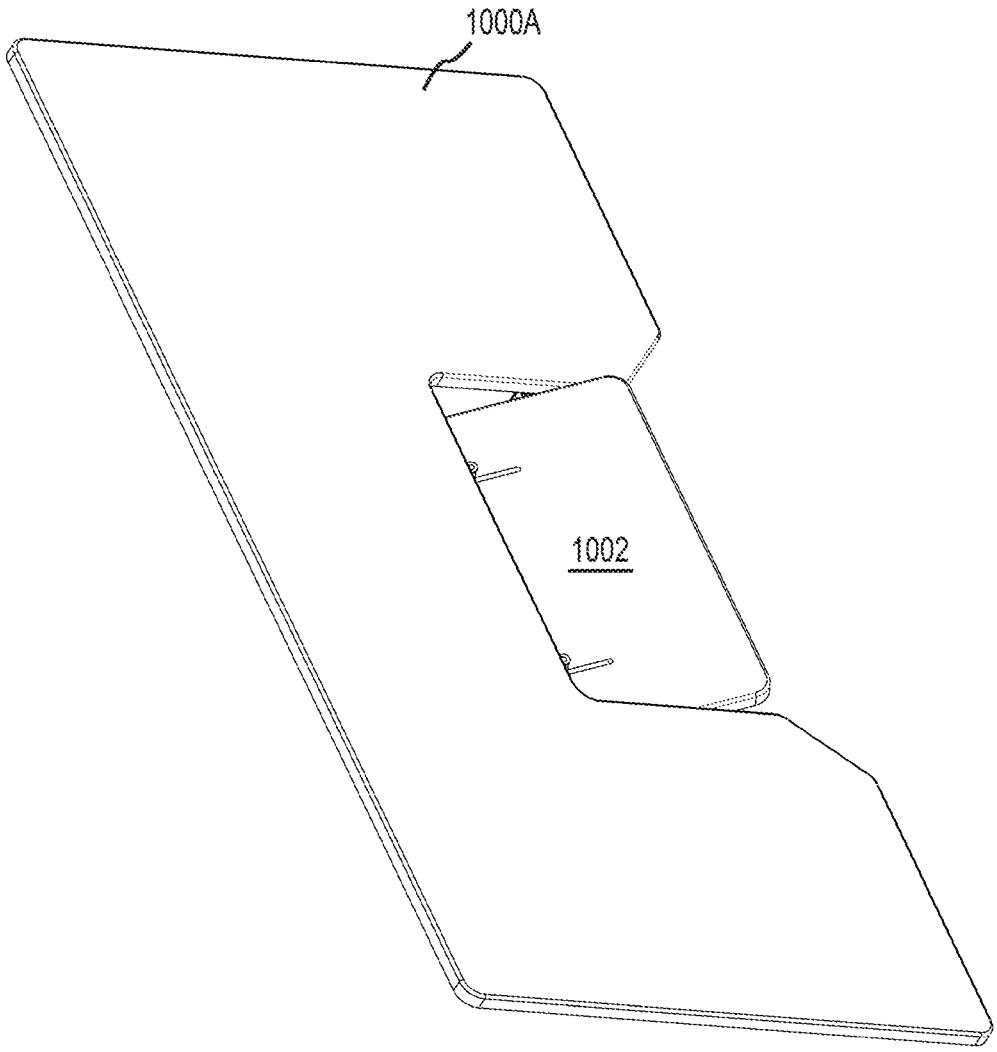
FIGS. 16A-16B illustrate multiple graphical projections of an embodiment of a keyboard mounting system connected to a table, wherein the table has a cutout to accommodate the keyboard mounting system and the keyboard mounting system is articulated.
Figure 16B:
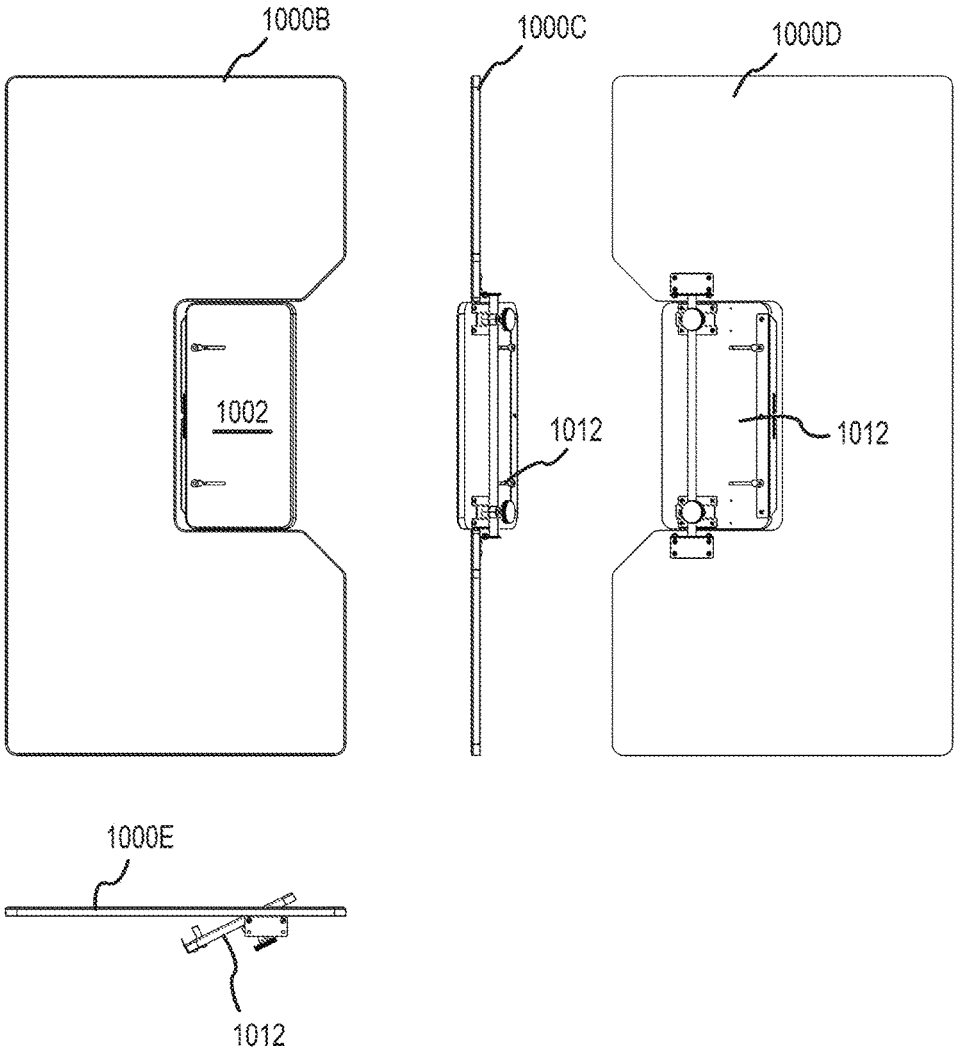

FIGS. 16A-B illustrate multiple graphical projections of an embodiment of system 1002 connected to table 1000, wherein table 1000 has a cutout to accommodate system 1002 and system 1002 is articulated. FIG. 16 illustrates an isometric view of table 1000 with system 1002 therewith and configured to be non co-planar. Table 1000A is an isometric view, table 1000B is a top view, table 1000C is a front view, table 1000D is a bottom view, and table 1000E is a side view each within attached system 1002.

Figure 17:
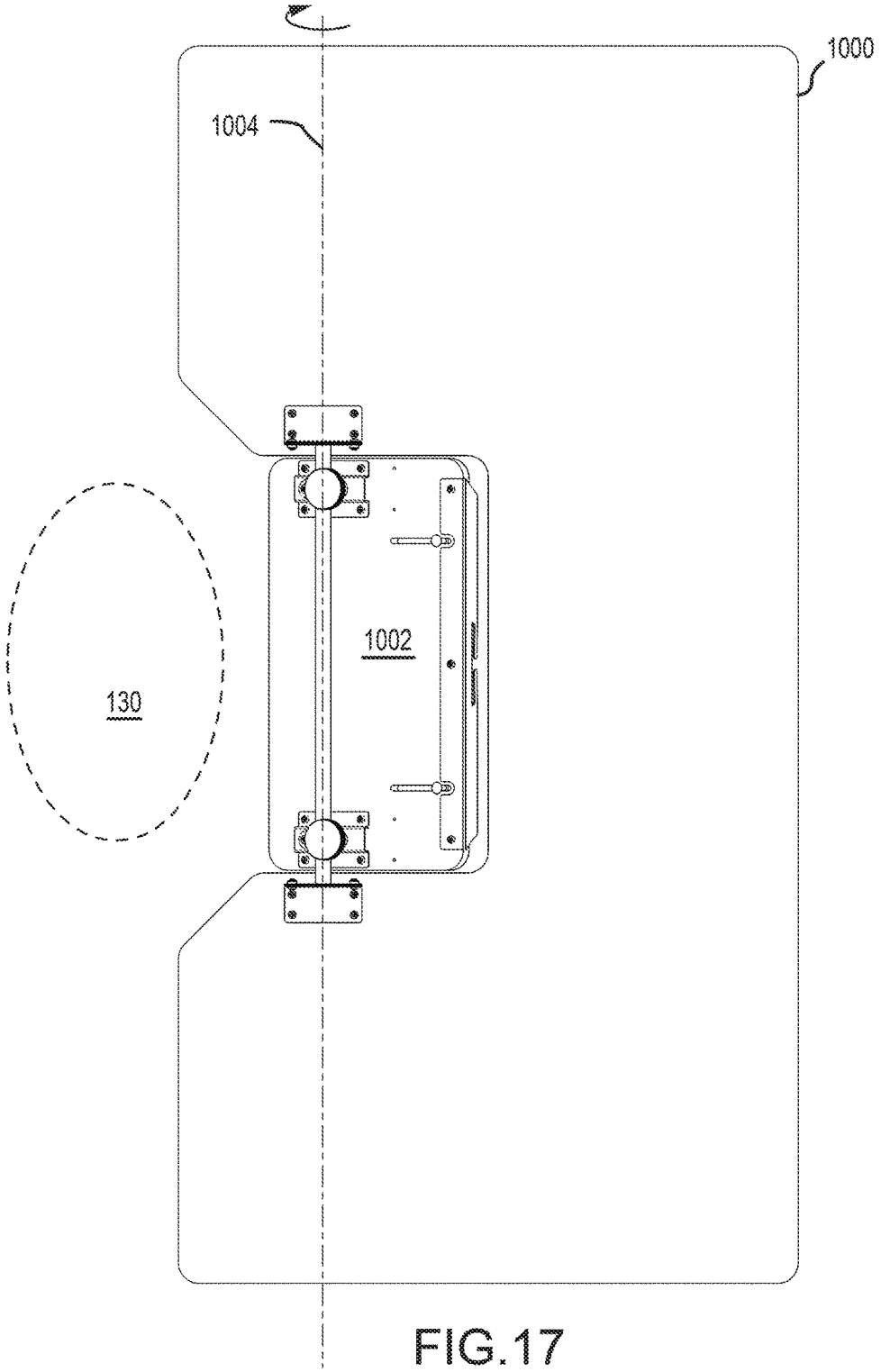
FIG. 17 illustrates one of the graphical projections of FIG. 16 with greater detail.

FIG. 17 illustrates one of the graphical projections of FIG. 16 with greater detail. System 1002 is provided to be rotationally configured along axis 1004 when attached to table 1000, such as to pitch system 1002 away from user-area 130.

Figure 18:
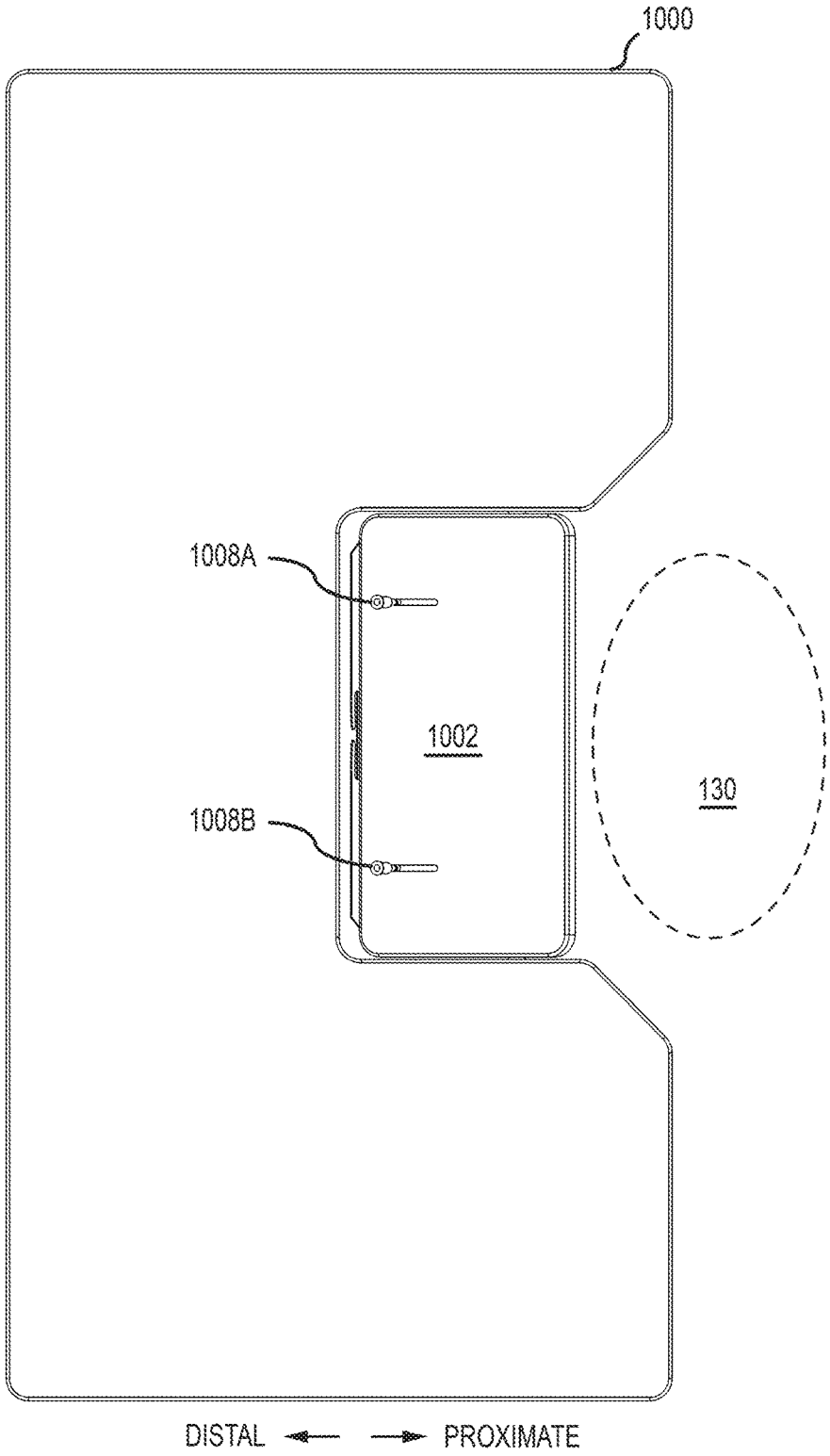
FIG. 18 illustrates one of the graphical projections of FIG. 16 with greater detail.

FIG. 18 illustrates one of the graphical projections of FIG. 16 with greater detail. FIG. 18 is substantially similar to FIG. 13, although with system 1002 pitched away from user-area 130. Pegs 1008A-B are provided on a distal portion of system 1002 to restrain a keyboard or other item placed thereon.

Figure 19:
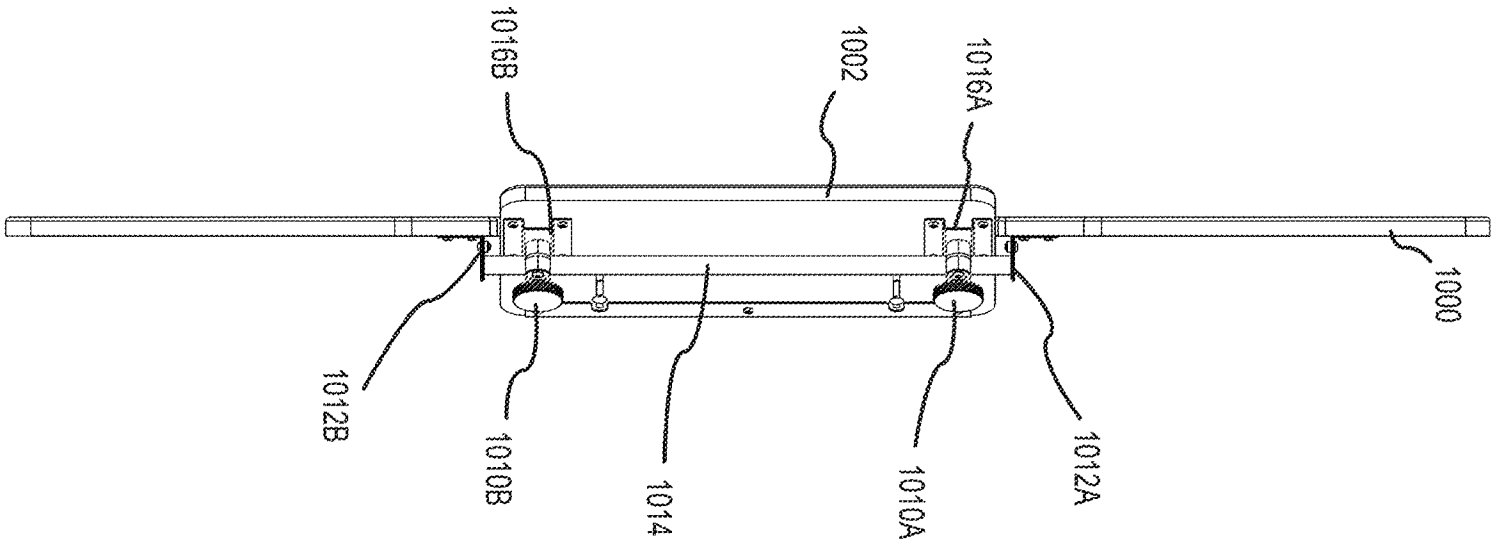
FIG. 19 illustrates one of the graphical projections of FIG. 16 with greater detail.

FIG. 19 illustrates one of the graphical projections of FIG. 16 with greater detail. FIG. 19 is substantially similar to FIG. 13 and illustrates system 1002 when pitched to be non co-planar with table 1000. System 1002 engages frame 1014 with clamps 1016 having a force determined by knob(s) 1010A-B. Frame 1014 may be affixed to brackets 1012, which, in turn, may be attached to table 1000.

Figure 20:
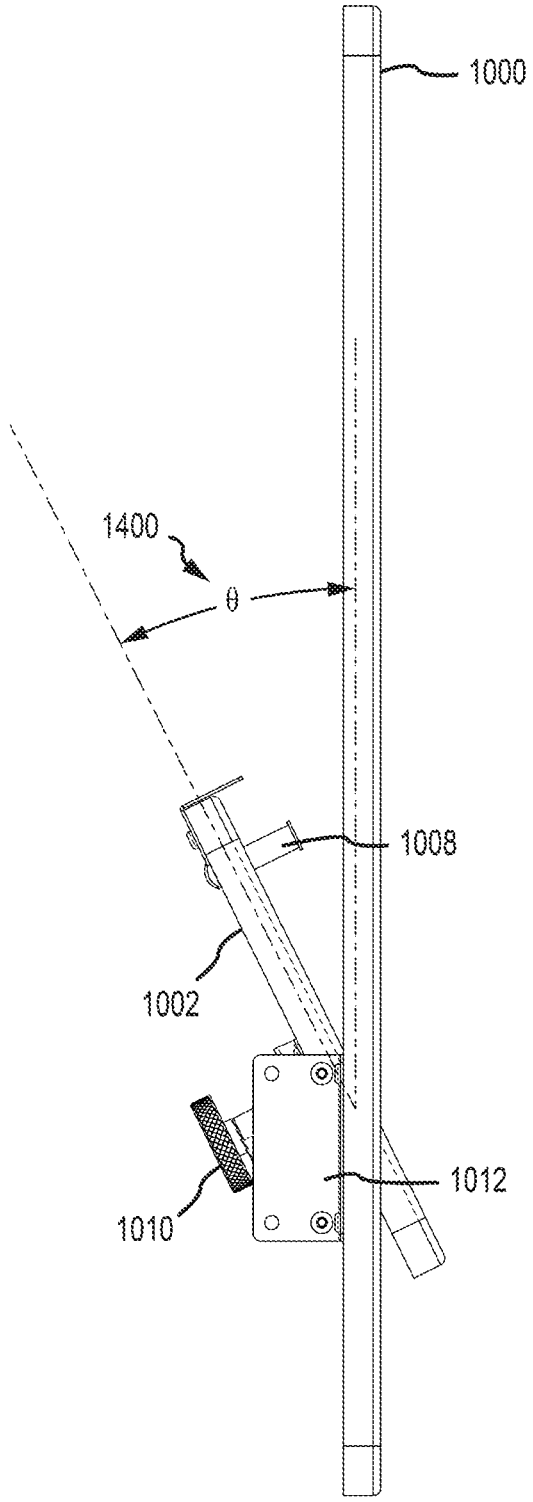
FIG. 20 illustrates one of the graphical projections of FIG. 16 with greater detail.

FIG. 20 illustrates one of the graphical projections of FIG. 16 with greater detail. FIG. 20 illustrates a side view of system 1002 attached to table 1000 in a non-planar configuration, specifically, angle theta 1400. System 1002 engages frame (not shown) with clamps (not shown) having a force determined, at least in part, by knob(s) 1010A-B. Frame 1014 (not shown) may be affixed to brackets 1012, which, in turn, may be attached to table 1000. Pegs 1008 may be provided, such as to restrain an item, such as a keyboard, placed on system 1002.

Figure 21:
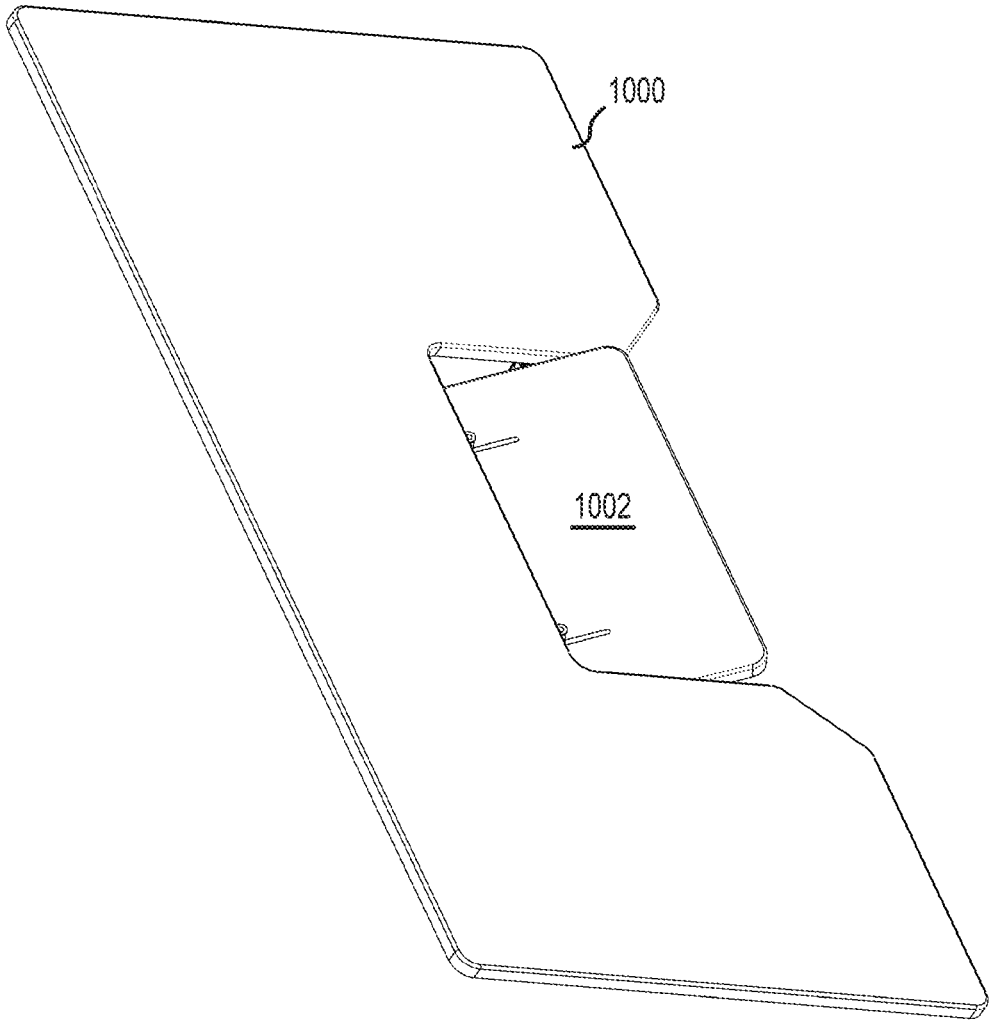
FIG. 21 illustrates one of the graphical projections of FIG. 16 with greater detail.

FIG. 21 illustrates one of the graphical projections of FIG. 16 with greater detail. System 1002 is disposed within the geometry of table 1000.

Figure 22A:
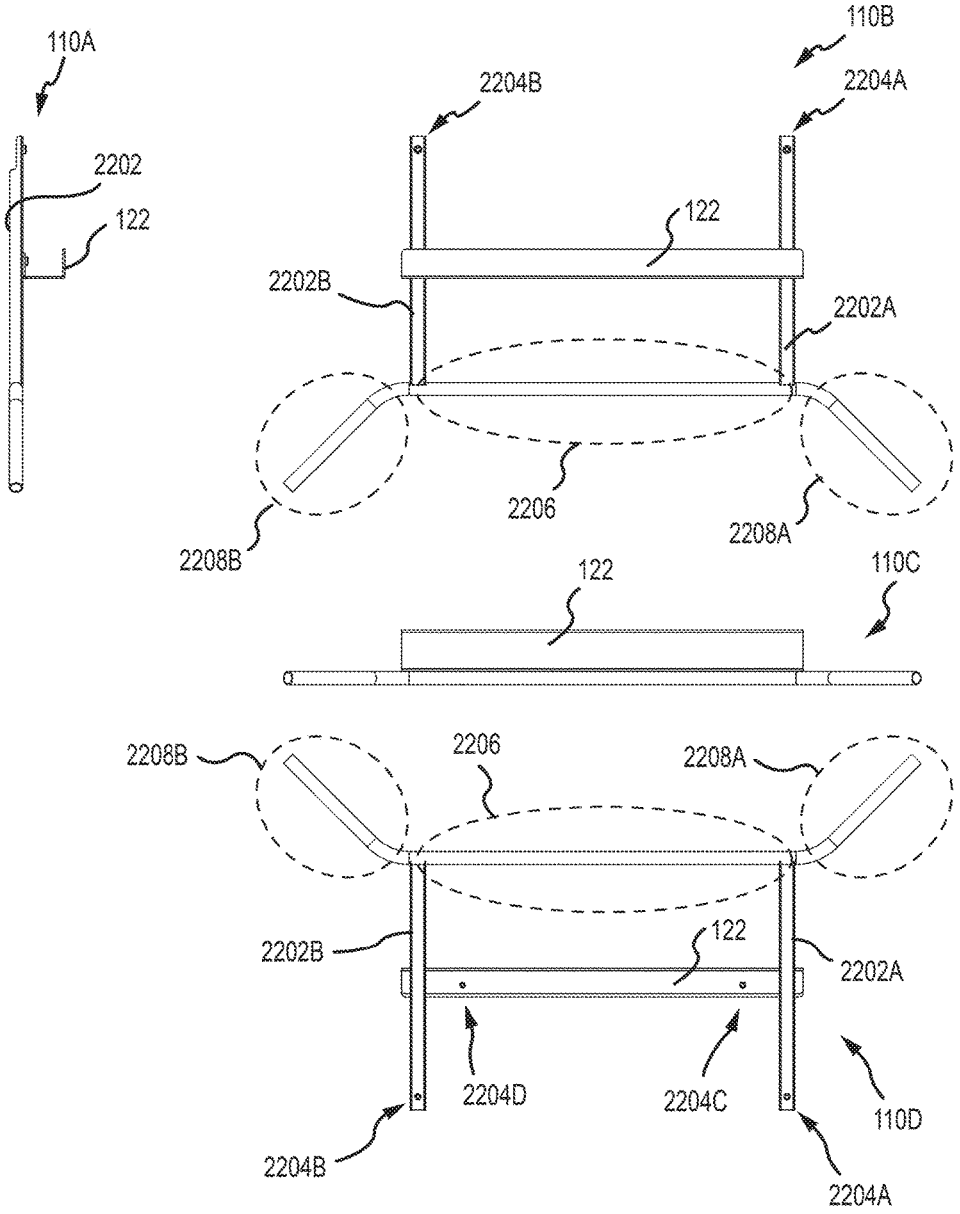
FIGS. 22A-22B illustrate isolated components of the keyboard and peripheral mounting system illustrated in FIGS. 1A-1B.
Figure 22B:
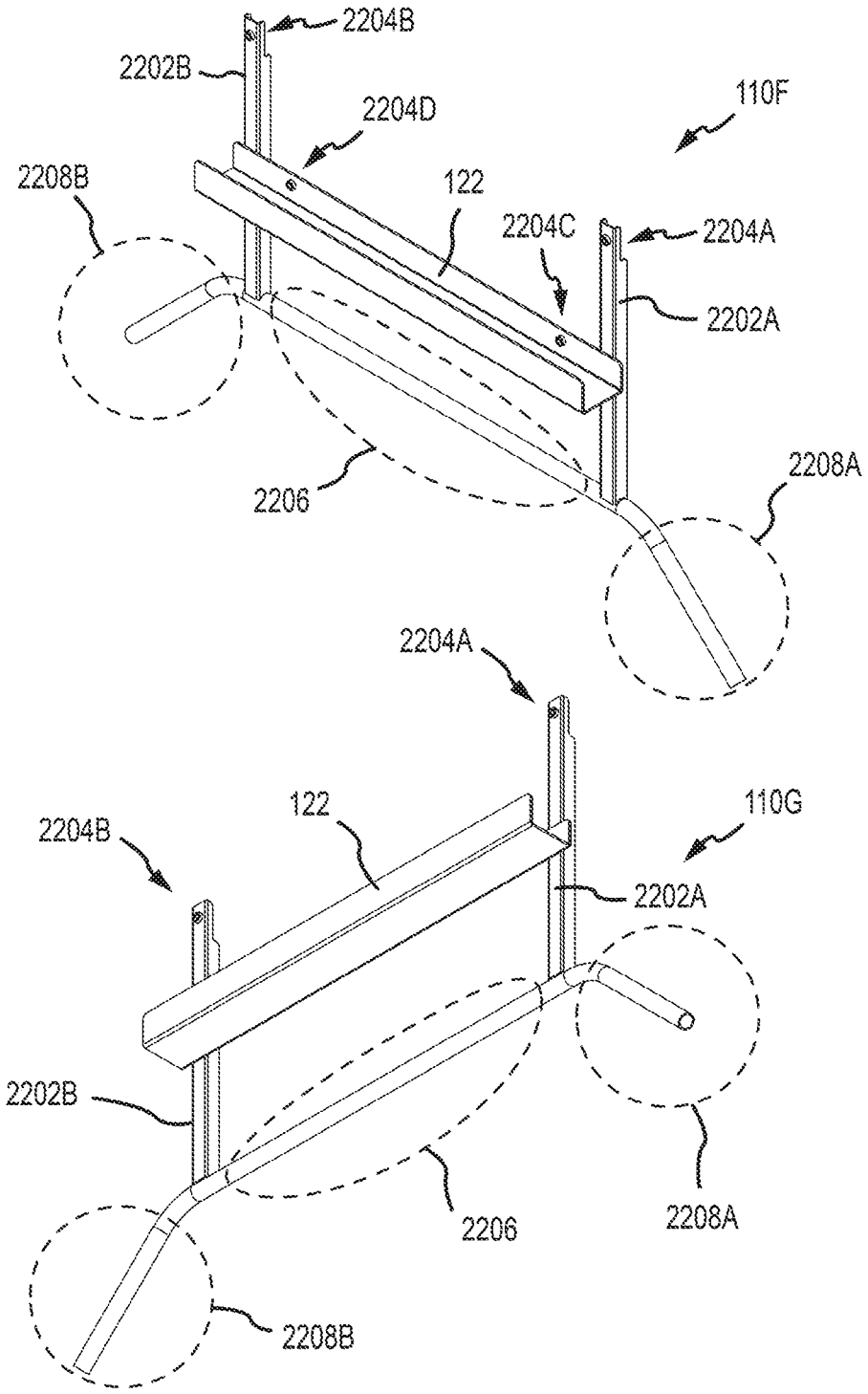

FIGS. 22A-B illustrate isolated components of system 102 illustrated in FIGS. 1A-1B. Frame 110A is illustrated in a side view, frame 110B is illustrated in a top view, frame 110C is illustrated in a front or back view, frame 110D is illustrated in a bottom view, frame 110F is illustrated in a first isometric view, and frame 110G is illustrated in a second isometric view. In one embodiment, frame 110 comprises various portions and elements. Arms 2202 are provided to distally extend frame 110, such as for engaging the underside of a work surface such as a table. Lip 122 is provided to engage an edge and/or top and, optionally, bottom of a table. Arms 2202 are provided with holes 2204A-B on the distal portion thereof, such as to accommodate an attachment adjustment mechanism, such as attached to knobs 108. Similarly, lip 122 may be provided while holes 2204C-D to accommodate an attachment adjustment means, such as knobs 116.

In one embodiment, keyboard supporting portion 2206 and arms 2202 are preferably formed to be a single component. Keyboard supporting portion 2206 and arms 2202 are provided showing no adjustment features thereon or between. As human input upon a keyboard comprises precise movements, the absence of such adjustment features facilitates rigidity of frame 110 and resulting keyboard support and/or peripheral supports attached thereto.

In another embodiment, frame 110 comprises keyboard supporting portion 2206 and optionally one or more laterally extending peripheral supporting portions 2208. Laterally extending portions 2208 may be non-co-axially aligned with keyboard supporting portion 2206.

Figure 23A:
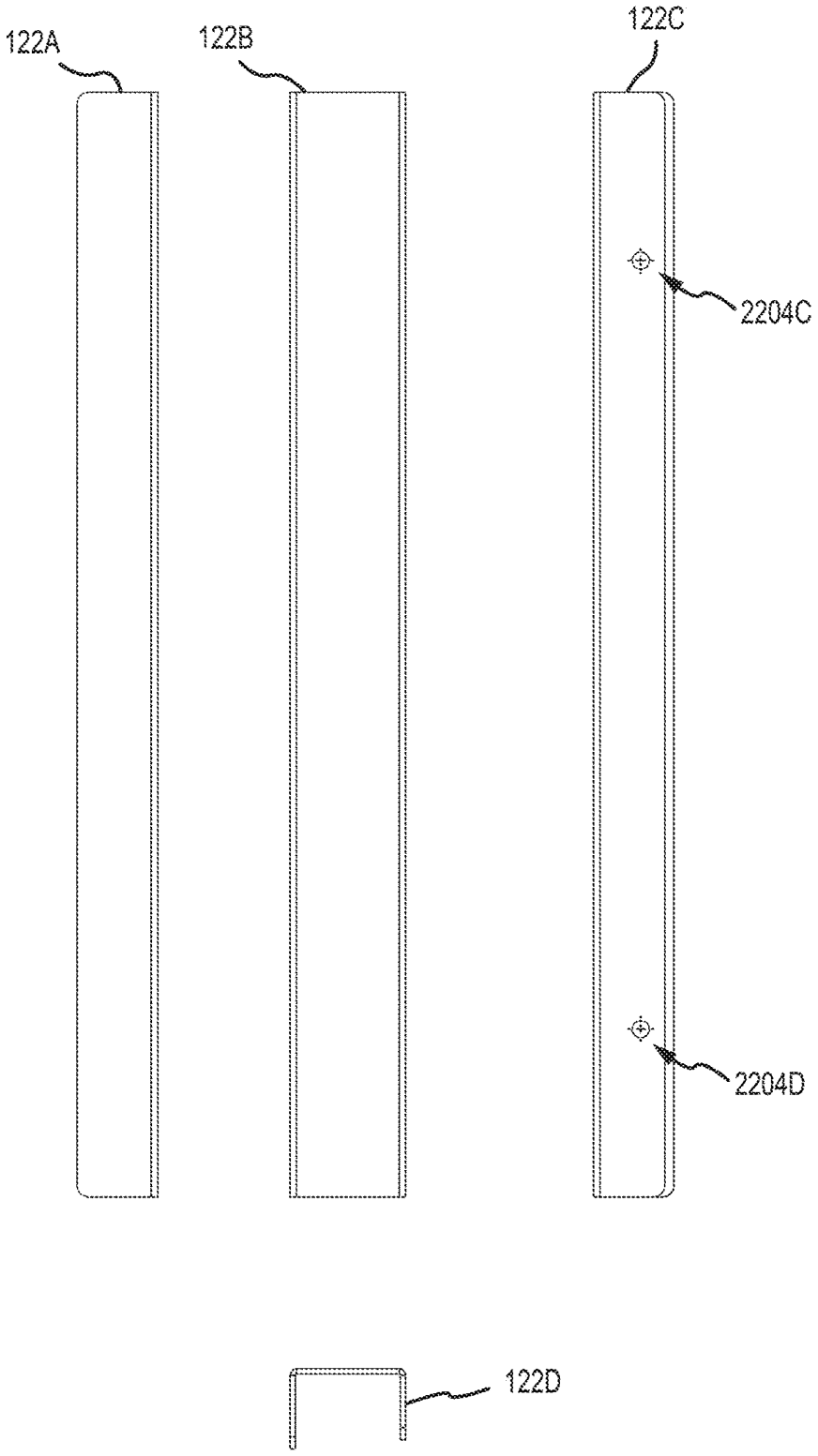
FIGS. 23A-23B illustrate isolated components of the keyboard and peripheral mounting system illustrated in FIGS. 1A-1B.
Figure 23B:
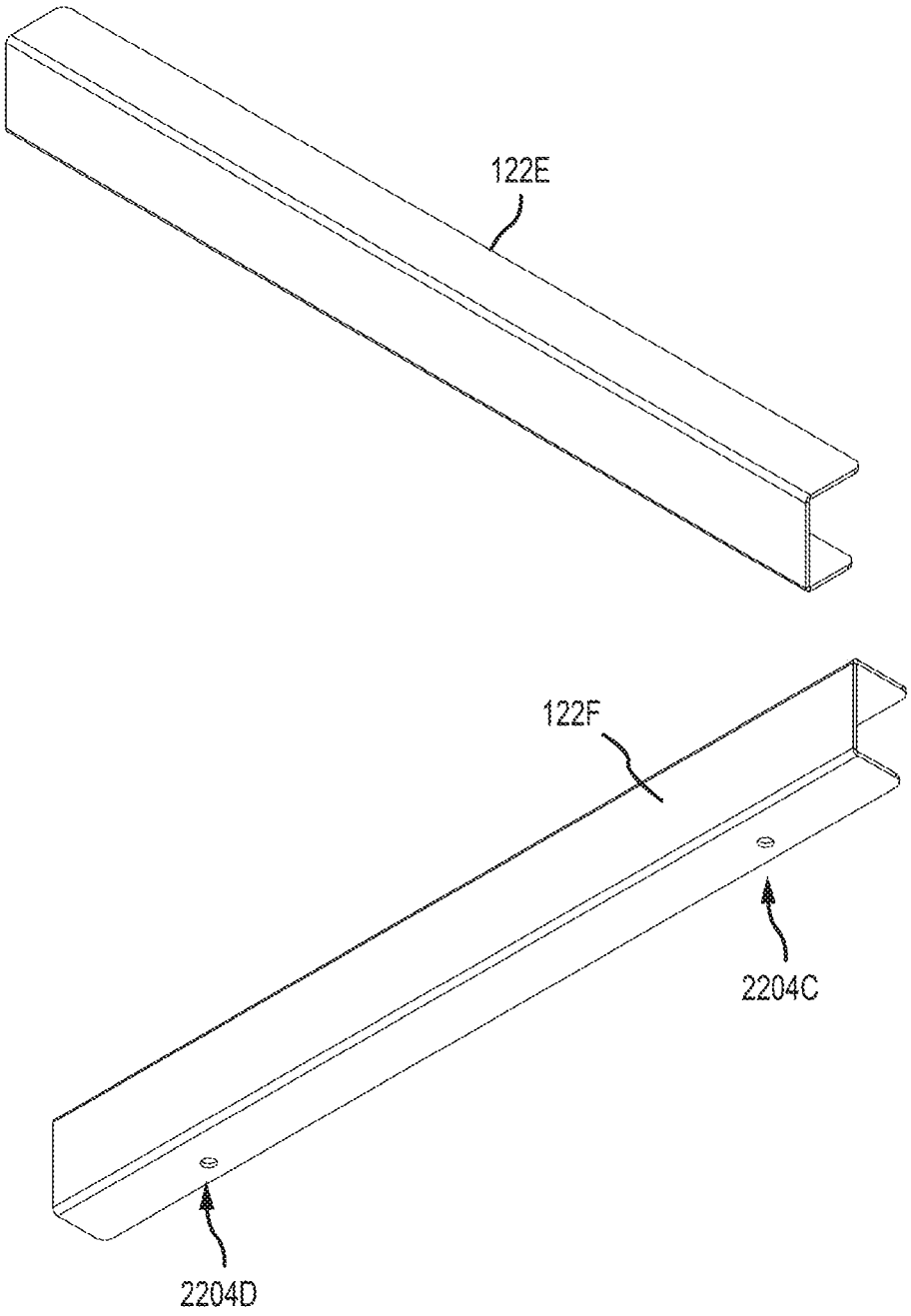

FIGS. 23A-B illustrate isolated components of system 102 illustrated in FIGS. 1A-1B. Lip 122A is illustrated in a top view, lip 122B is illustrated in a rear or front view, lip 122C is illustrated in a bottom view, lip 122D is illustrated in a side view, lip 122E is illustrated to show a first isometric view, and lip 122F is illustrated to show a second isometric view. Lip 122D and lip 122F shows holes 2204C-D.

Figure 24A:
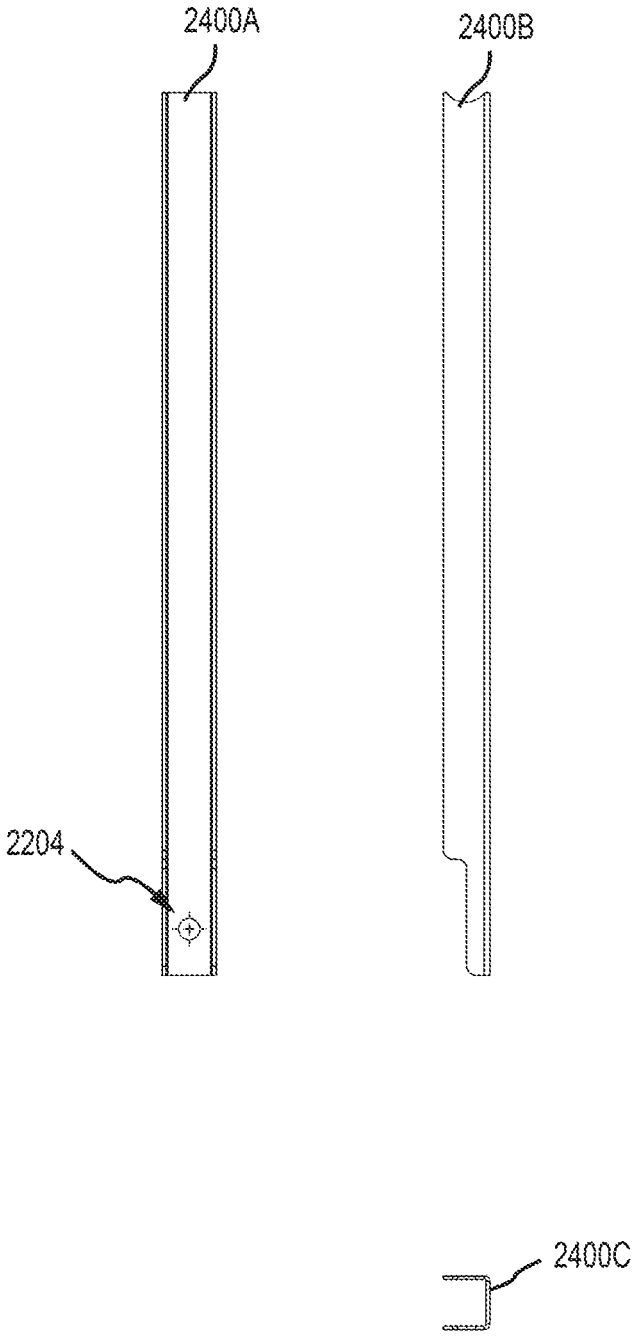
FIGS. 24A-24B illustrate isolated components of the keyboard and peripheral mounting system illustrated in FIGS. 1A-1B.
Figure 24B:
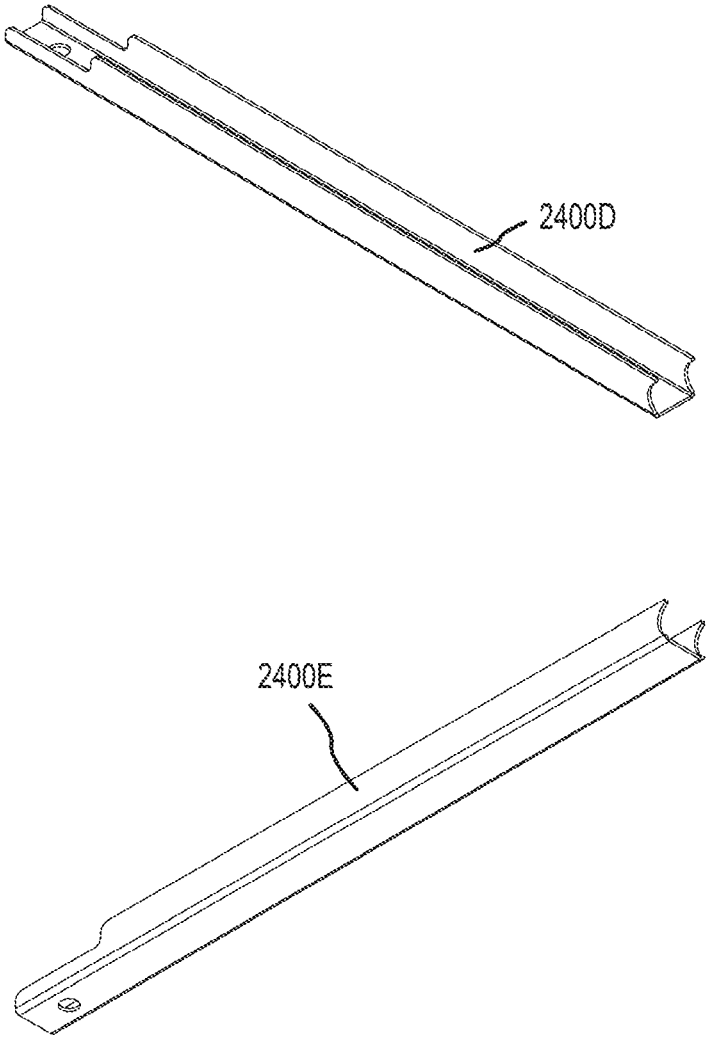

FIGS. 24A-B illustrate isolated components system 102 illustrated in FIGS. 1A-1B. Arm 2400 is illustrated as one of arms 2400A-D. Arm 2400A is illustrated in a bottom/top view with hole 2204, arm 2400B is illustrated in a side view, arm 2400C is illustrated in a front/back view, arm 2400D is illustrated in a first isometric view, and arm 2400E is illustrated in a second isometric view.

Figure 25A:
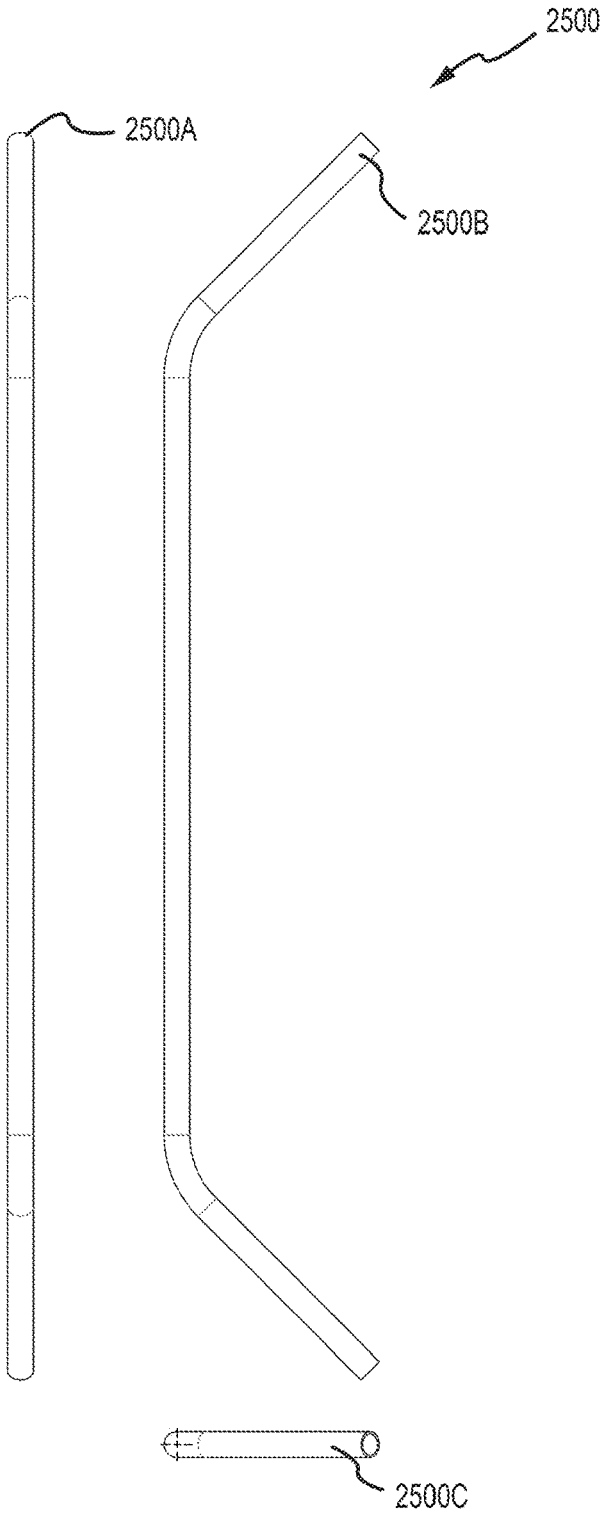
FIGS. 25A-25B illustrate isolated components of the keyboard and peripheral mounting system illustrated in FIGS. 1A-1B.
Figure 25B:
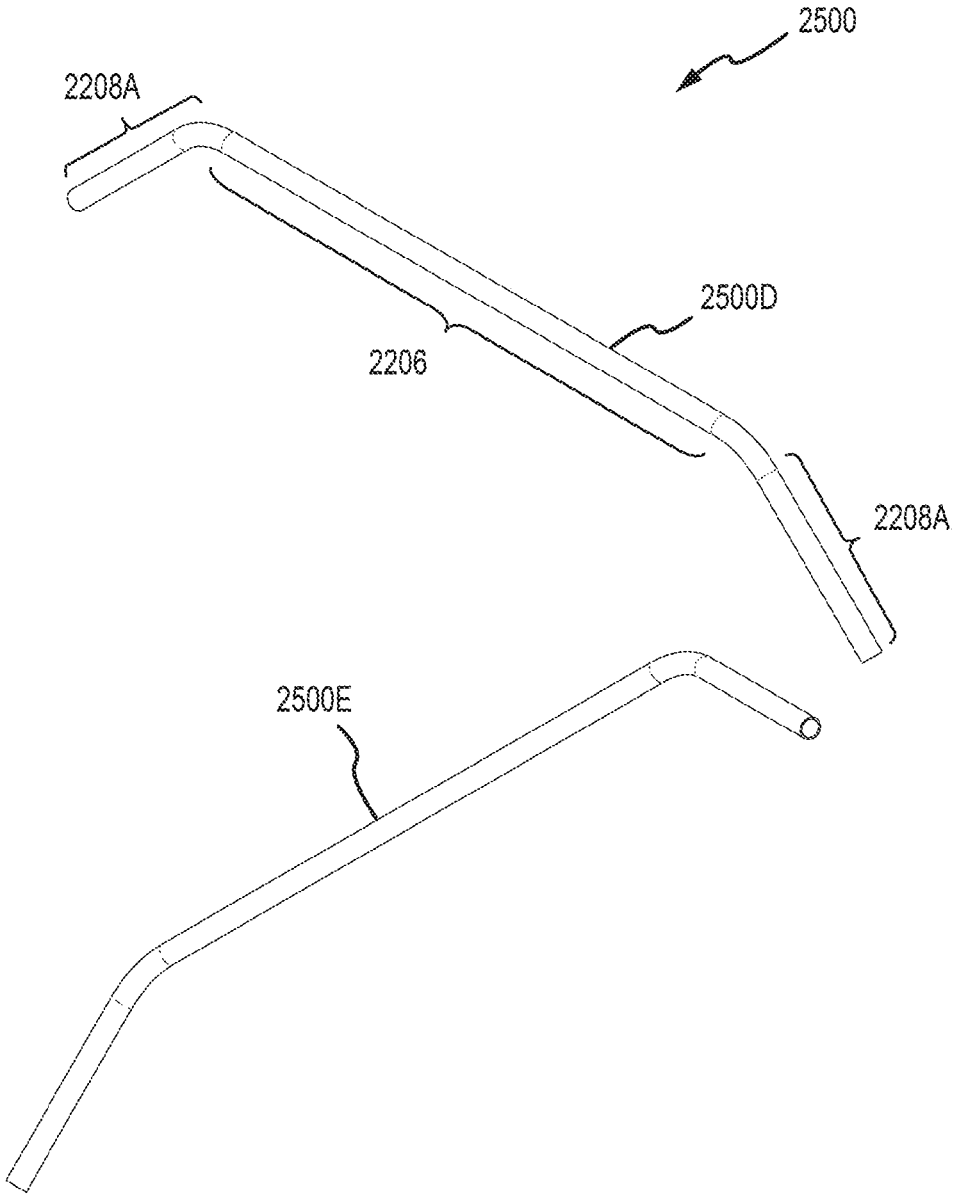

FIGS. 25A-B illustrate isolated components of system 102 illustrated in FIGS. 1A-1B. System 102 comprises frame 110. In one embodiment, a supporting portion 2500 of frame 110 is illustrated as a tubular structure, such as to accommodate the rotational positioning of one or more of keyboard support 104 or peripheral supports 106A and/or 106B. Supporting portion 2500A is illustrated in a front/back view, supporting portion 2500B is illustrated in a top/bottom view, supporting portion 2500C is illustrated in a side view, supporting portion 2500D is illustrated in a first isometric view, and supporting portion 2500E is illustrated in a second isometric view. Supporting portion 2500D is illustrated to show keyboard supporting portion 2206 and peripheral supporting portions 2208A-B.

Figure 26A:
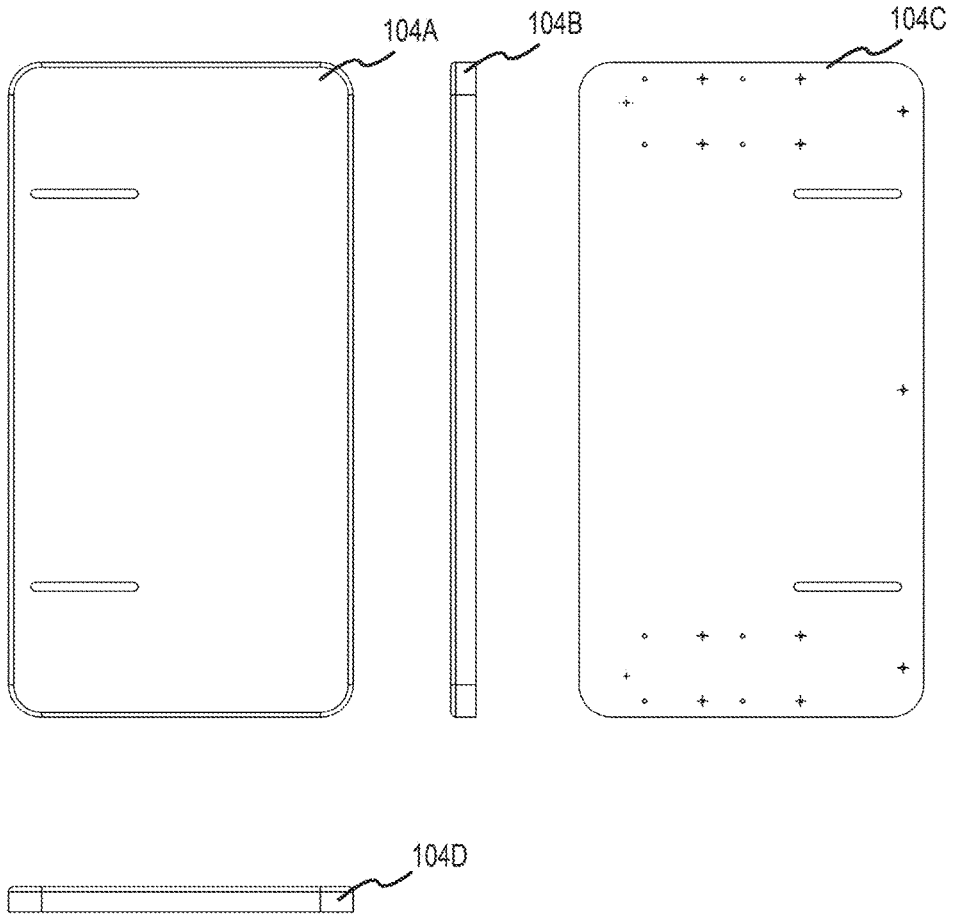
FIGS. 26A-26B illustrate isolated components of the keyboard and peripheral mounting system illustrated in FIGS. 1A-1B.
Figure 26B:
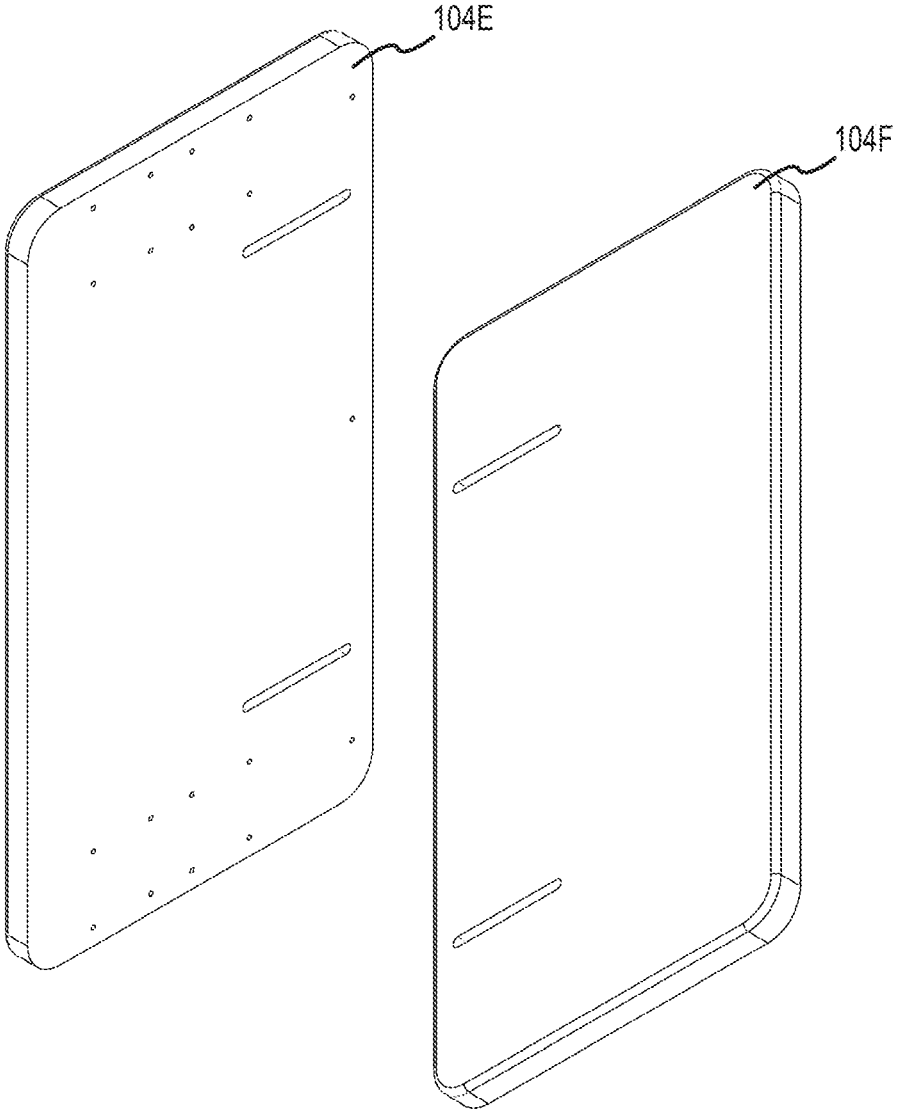

FIGS. 26A-B illustrate isolated components of system 102 illustrated in FIGS. 1A-1B. Keyboard support 104A is illustrated in a top view, keyboard support 104B is illustrated in a front/back view, keyboard support 104C is illustrated in a bottom view, keyboard support 104D is illustrated in a side view, keyboard support 104E is illustrated in a first isometric view, and keyboard support 104F is illustrated in a second isometric view.

Figure 27A:
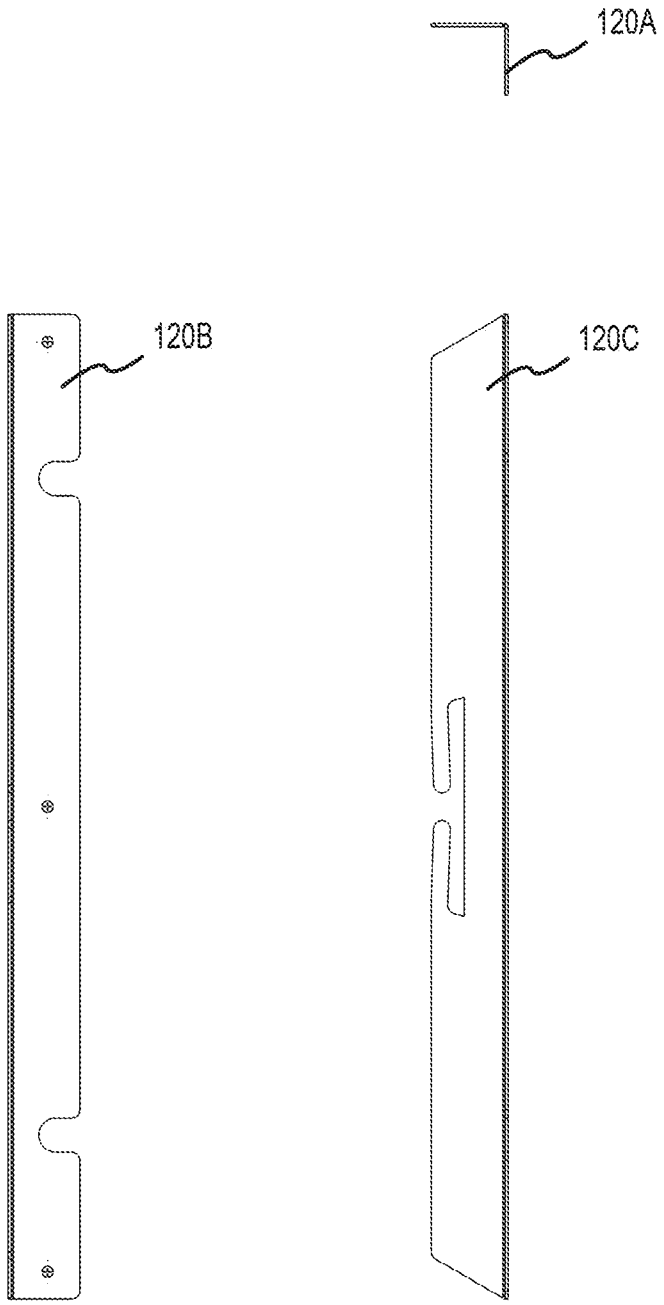
FIGS. 27A-27B illustrate isolated components of the keyboard and peripheral mounting system illustrated in FIGS. 1A-1B.
Figure 27B:
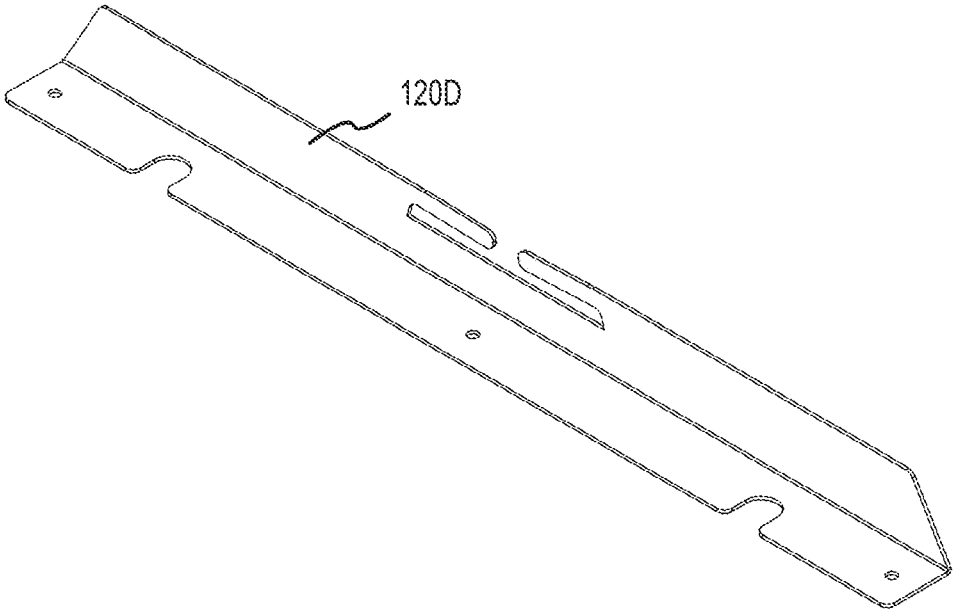

FIGS. 27A-B illustrate isolated components of system 102 illustrated in FIGS. 1A-1B. Rear fence 120A is illustrated in a side view, rear fence 120B is illustrated in a top/bottom view, rear fence 120C is illustrated in a front/back view, and keyboard support 120D is illustrated in an isometric view.

Figure 28A:
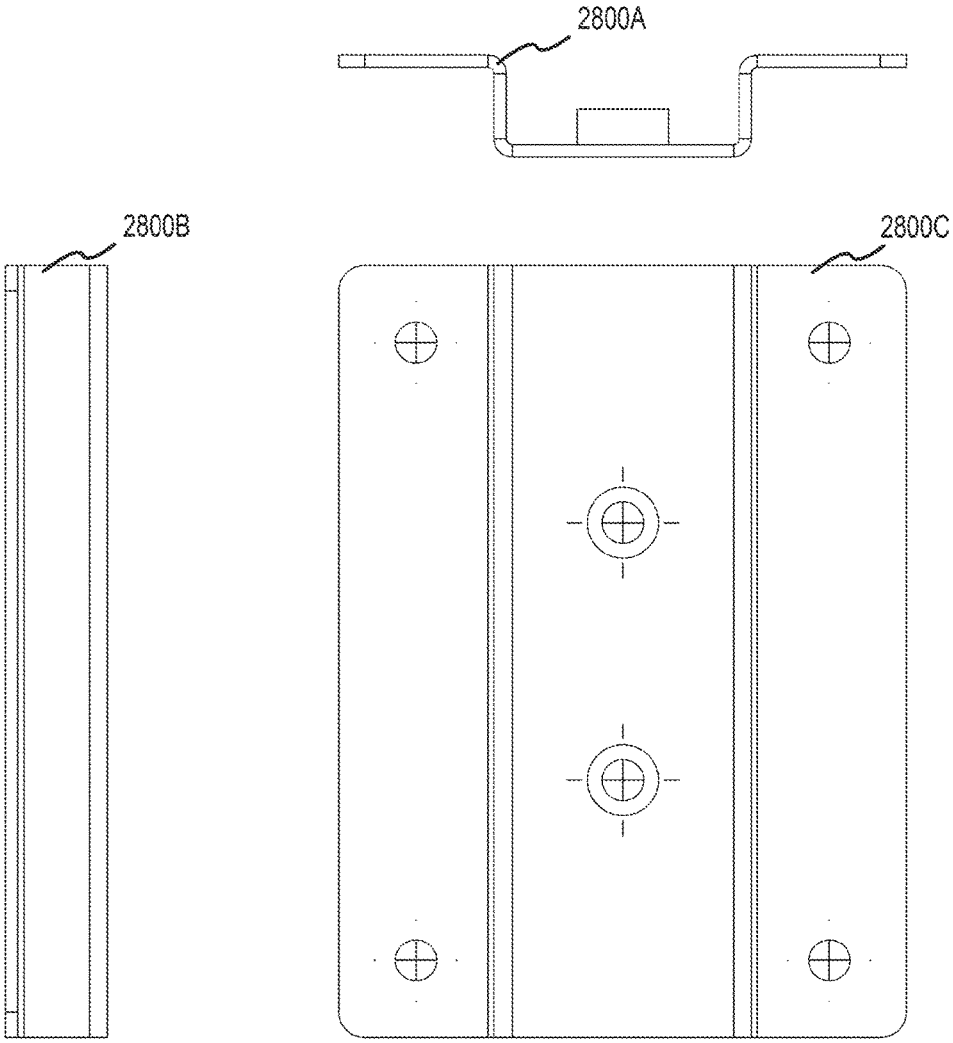
FIGS. 28A-28B illustrate isolated components of the keyboard and peripheral mounting system illustrated in FIGS. 1A-1B.
Figure 28B:
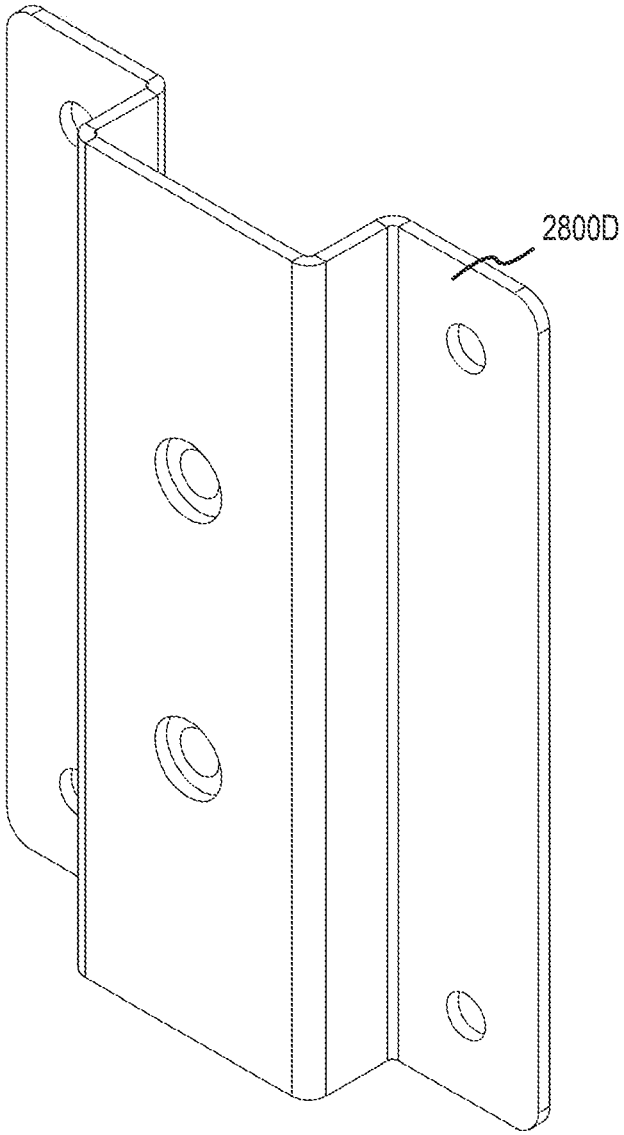

FIGS. 28A-B illustrate isolated components of system 102 illustrated in FIGS. 1A-1B. A clamp, such as clamp 108, comprises components, such as bracket 2800, for attachment to a surface, such as the underside of keyboard support 104 and/or peripheral support 106A and/or 106B. Bracket 2800A is illustrated in a front/back view, bracket 2800B is illustrated in a side view, bracket 2800C is illustrated in a top/bottom view, and bracket 2800D is illustrated in an isometric view.

Figure 29A:
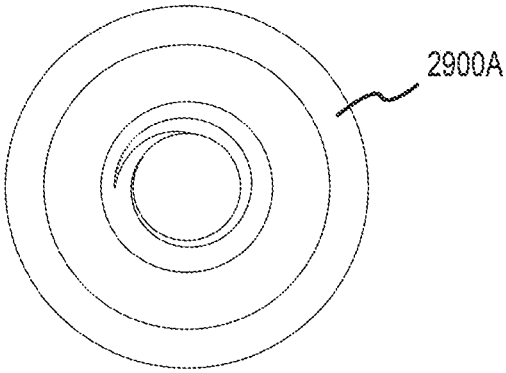
FIGS. 29A-29B illustrate isolated components of the keyboard and peripheral mounting system illustrated in FIGS. 1A-1B.
Figure 29A:
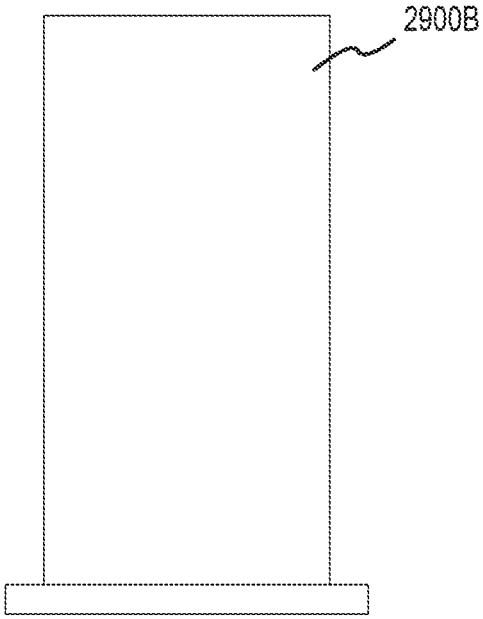
Figure 29B:
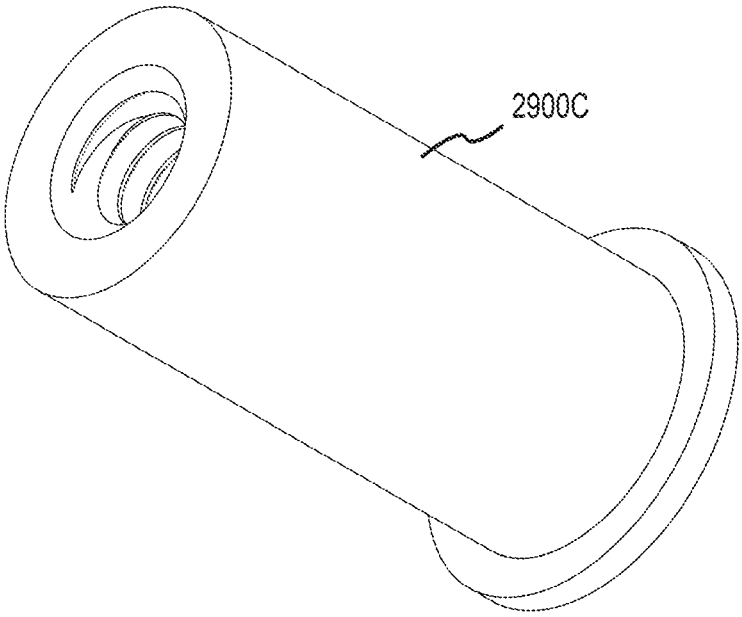

FIGS. 29A-B illustrate isolated components of system 102 illustrated in FIGS. 1A-1B. A peg, such as peg 118, comprises components, such as threaded member 2900, for adjustably positioning, removing, and attaching to a corresponding threaded rod to engage a surface, such as keyboard support 104, and provide a restraint to a device, such as a keyboard, placed thereon. Threaded member 2900A is illustrated in a top view, threaded member 2900B is illustrated in a side view, and threaded member 2900C is illustrated in an isometric view.

Figure 30A:
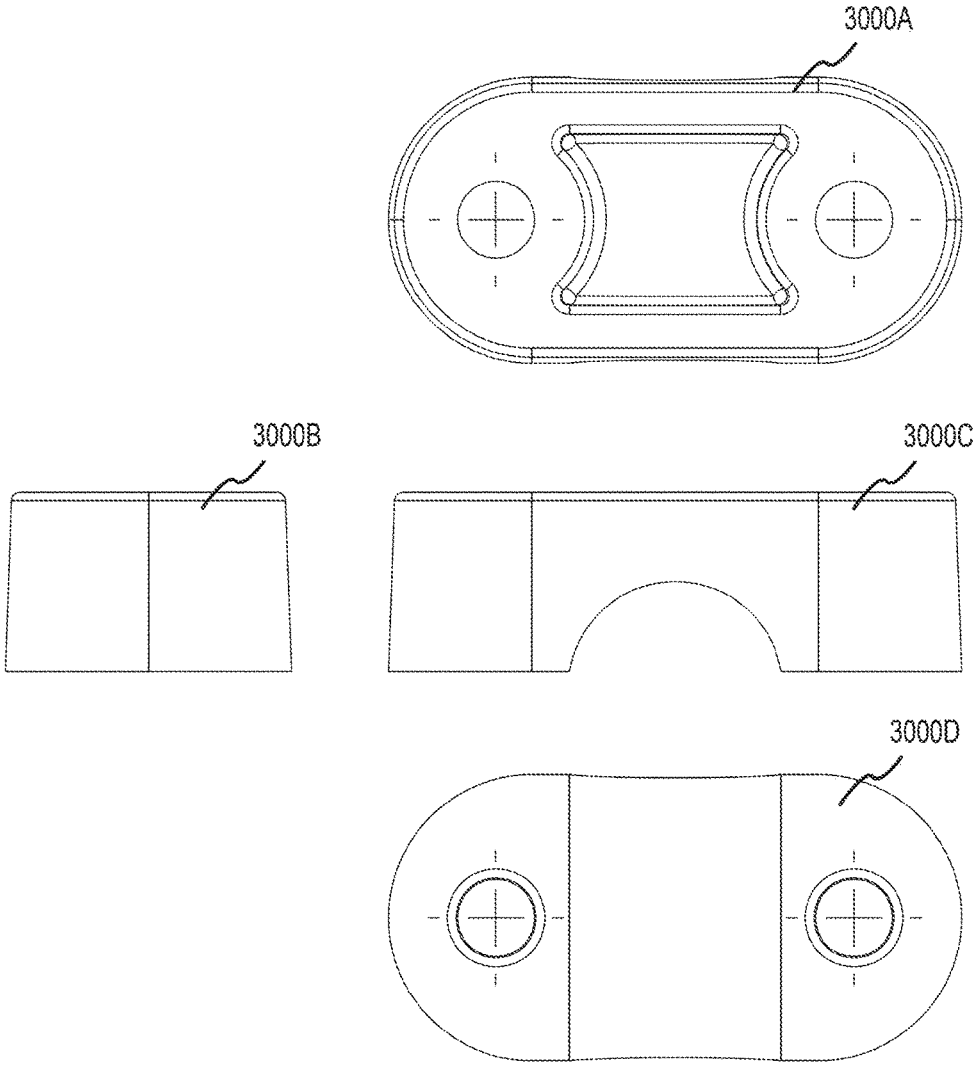
FIGS. 30A-30B illustrate isolated components of the keyboard and peripheral mounting system illustrated in FIGS. 1A-1B.
Figure 30B:
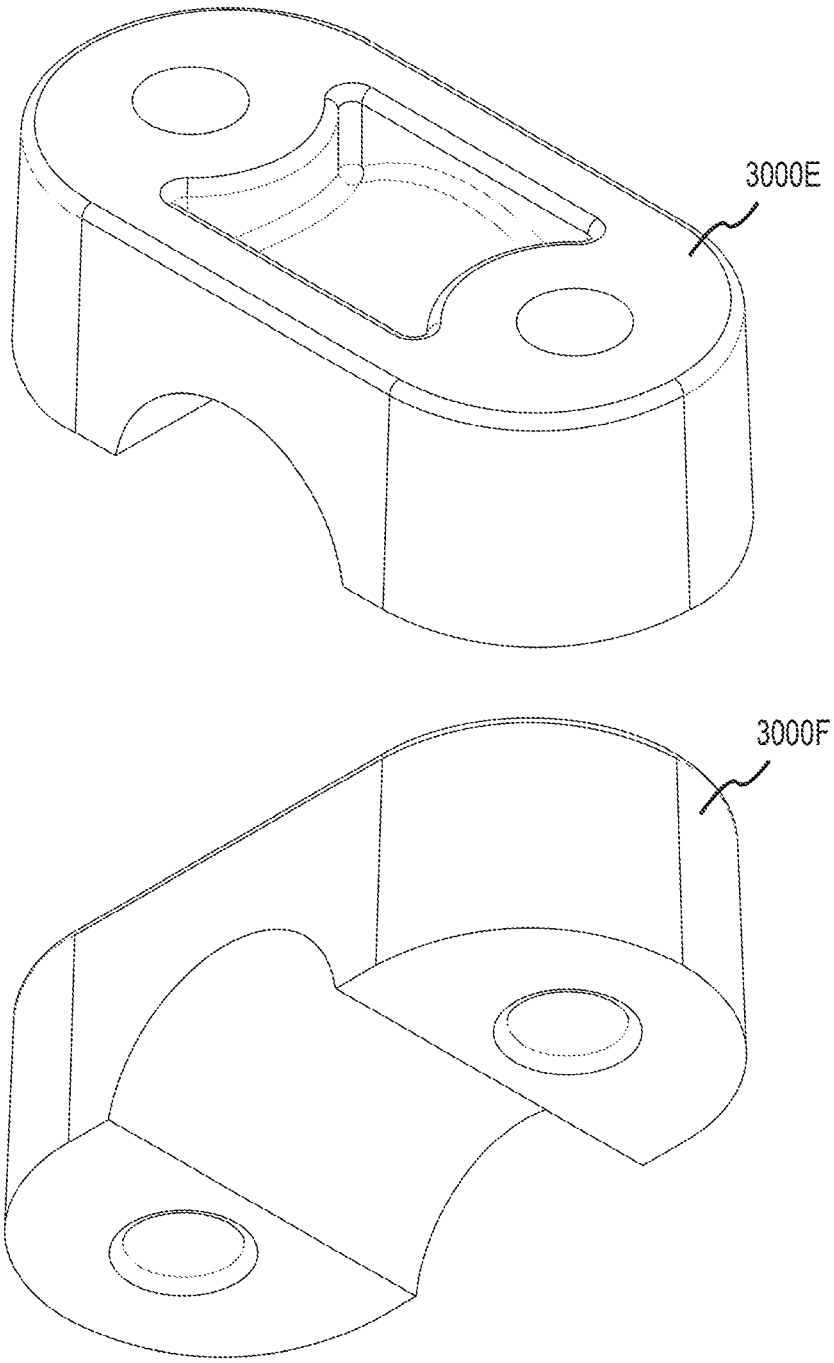

FIGS. 30A-B illustrate isolated components of system 102 illustrated in FIGS. 1A-1B. A clamp, such as clamp 108, comprises components, such as bracket 3000 for attachment to a surface, such as frame 110, and more particularly to a tubular structure, such as one or more of keyboard supporting areas 2206 and/or one or both of peripheral supporting areas 2208A and/or 2208B and for securing to a surface, such as keyboard support 104 and/or peripheral support 106A and/or 106B. Bracket 3000A is illustrated in a top view, bracket 3000B is illustrated in a side view, bracket 3000C is illustrated in a front/rear view, and bracket 3000D is illustrated in a bottom view, bracket 3000E is illustrated in a first isometric view, and bracket 3000F is illustrated in a second isometric view.

Figure 31A:
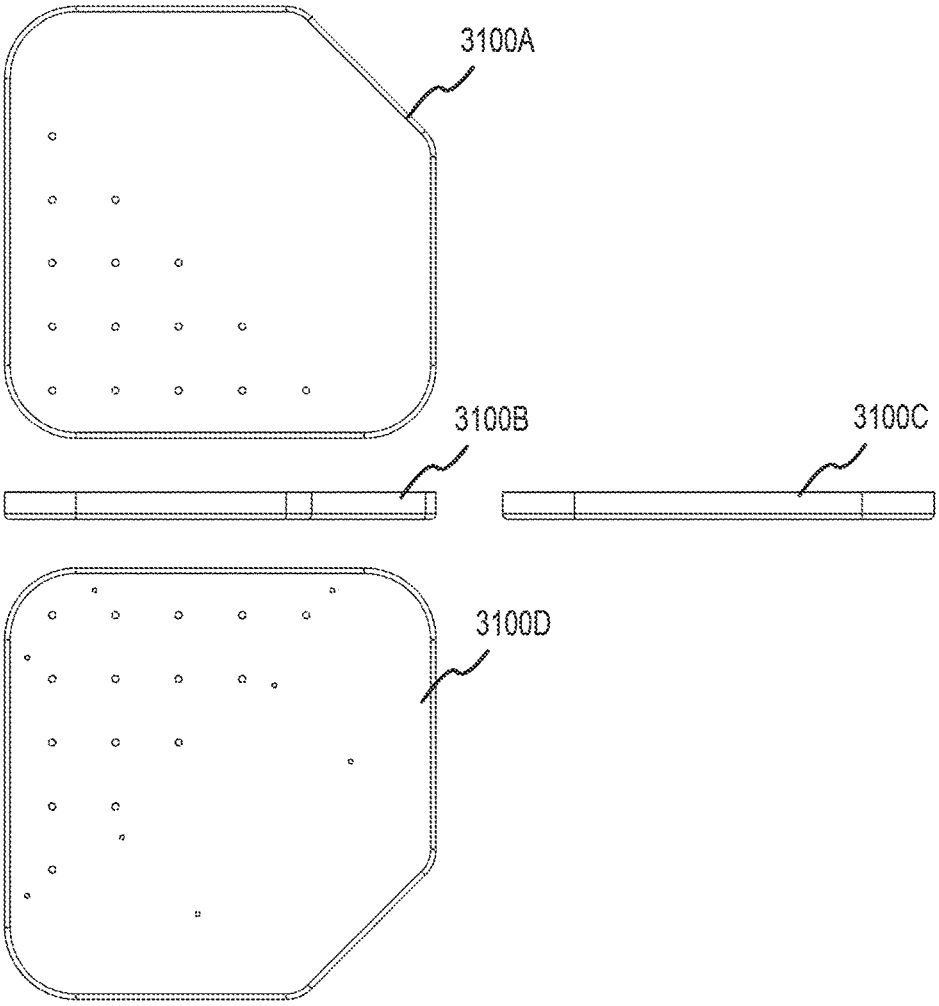
FIGS. 31A-31B illustrate isolated components of the keyboard and peripheral mounting system illustrated in FIGS. 1A-1B.
Figure 31B:
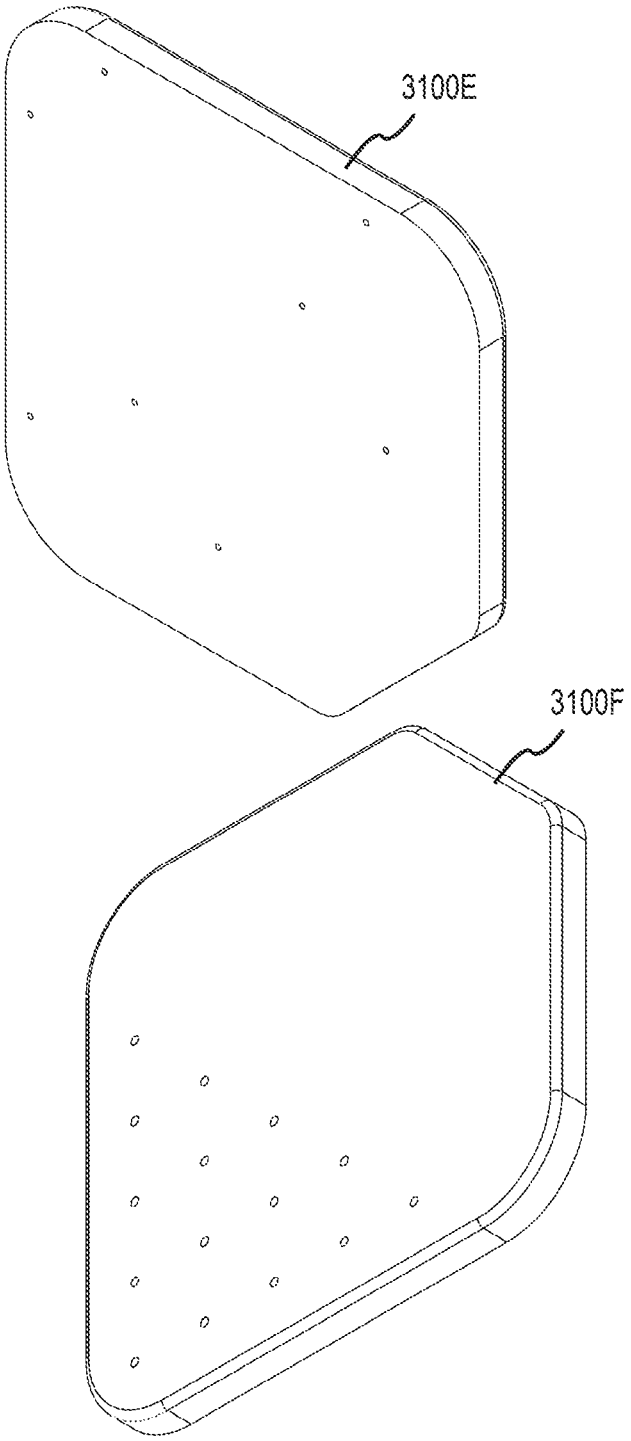

FIGS. 31A-B illustrate isolated components of system 102 illustrated in FIGS. 1A-1B. In one embodiment, peripheral support 3100 illustrates one of peripheral support 106A or 106B. It should be appreciated that a mirror image is contemplated to describe the other of peripheral support 106A or 106B. In one embodiment, peripheral support 3100A is illustrated in a top view, peripheral support 3100B is illustrated in a side view, peripheral support 3100C is illustrated in a front/back view, peripheral support 3100D is illustrated in a bottom view, peripheral support 3100E is illustrated in a first isometric view, and peripheral support 3100F is illustrated in a second isometric view.

Figure 32A:
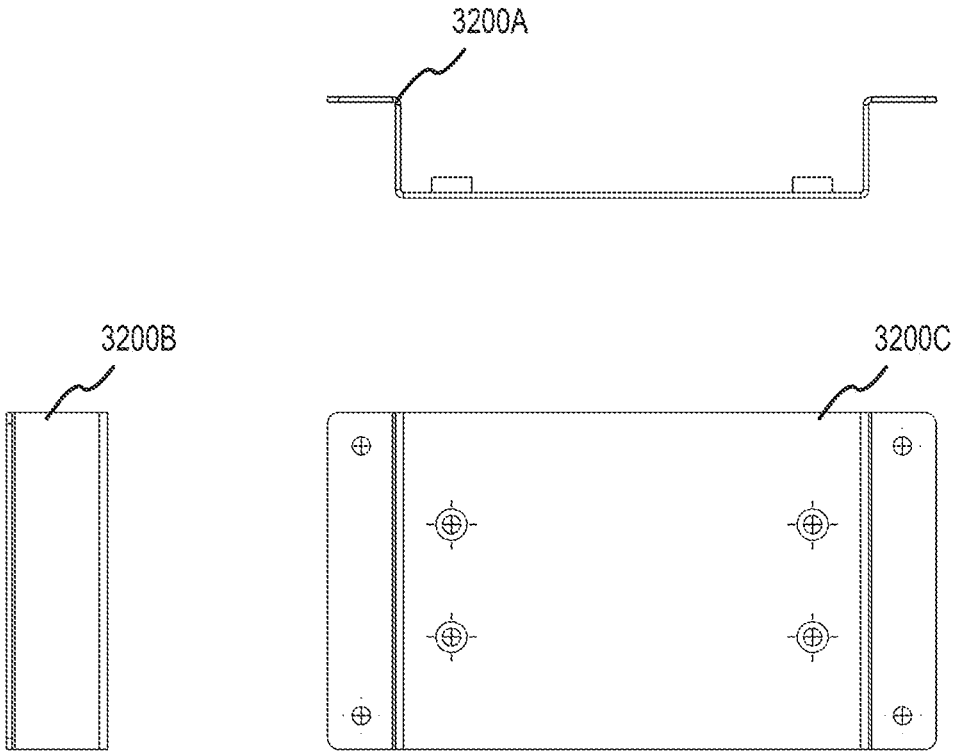
FIGS. 32A-32B illustrate isolated components of the keyboard and peripheral mounting system illustrated in FIGS. 1A-1B.
Figure 32B:
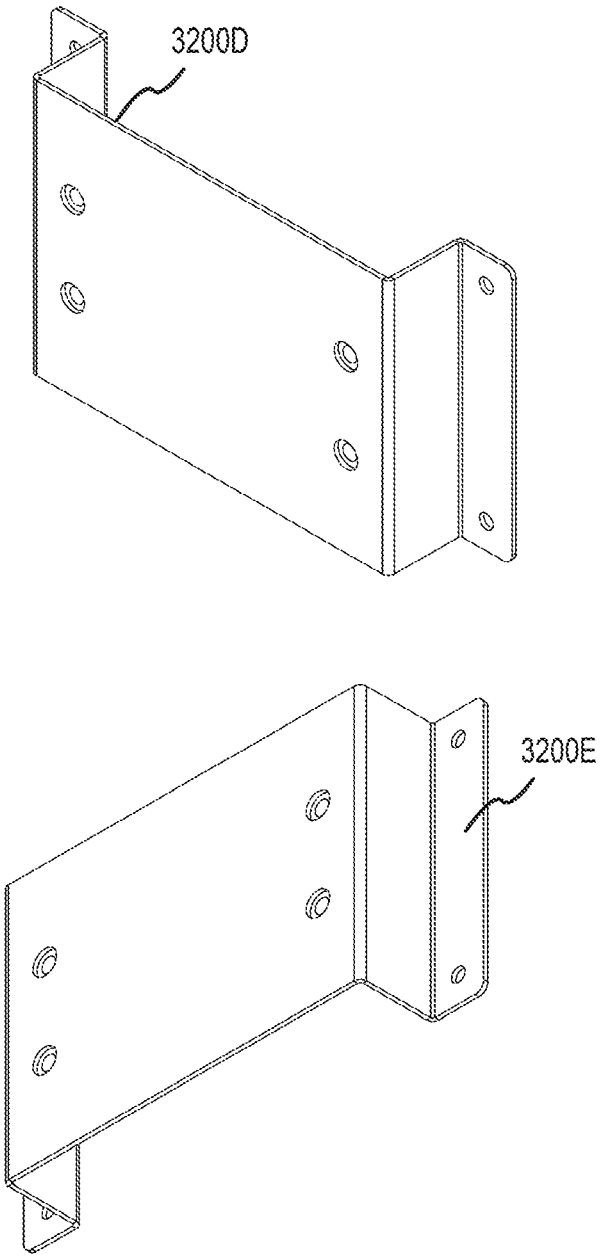

FIGS. 32A-B illustrate isolated components of system 102 illustrated in FIGS. 1A-1B. A clamp, such as clamp 108, comprises components, such as bracket 3200 for attachment to a surface, such as the underside of keyboard support 104 and/or peripheral support 106A and/or 106B. Bracket 3200A is illustrated in a front/back view, bracket 3200B is illustrated in a side view, bracket 3200C is illustrated in a top/bottom view, bracket 3200D is illustrated in a first isometric view, and bracket 3200E is illustrated in a second isometric view.

Figure 33A:
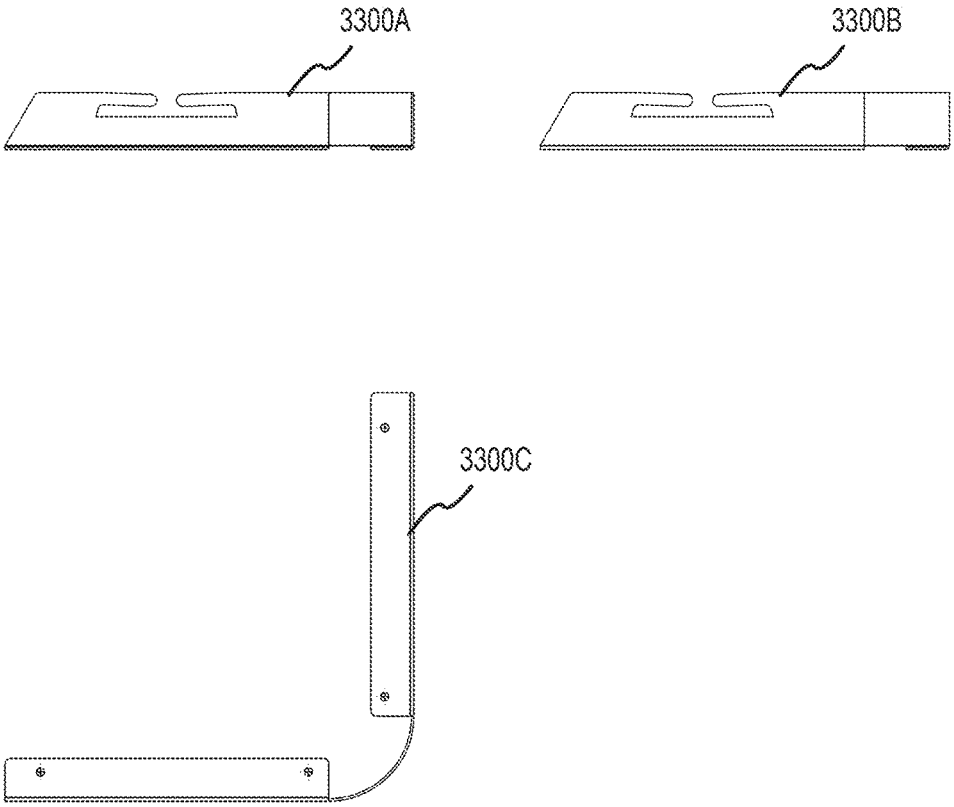
FIGS. 33A-33B illustrate isolated components of the keyboard and peripheral mounting system illustrated in FIGS. 1A-1B.
Figure 33B:
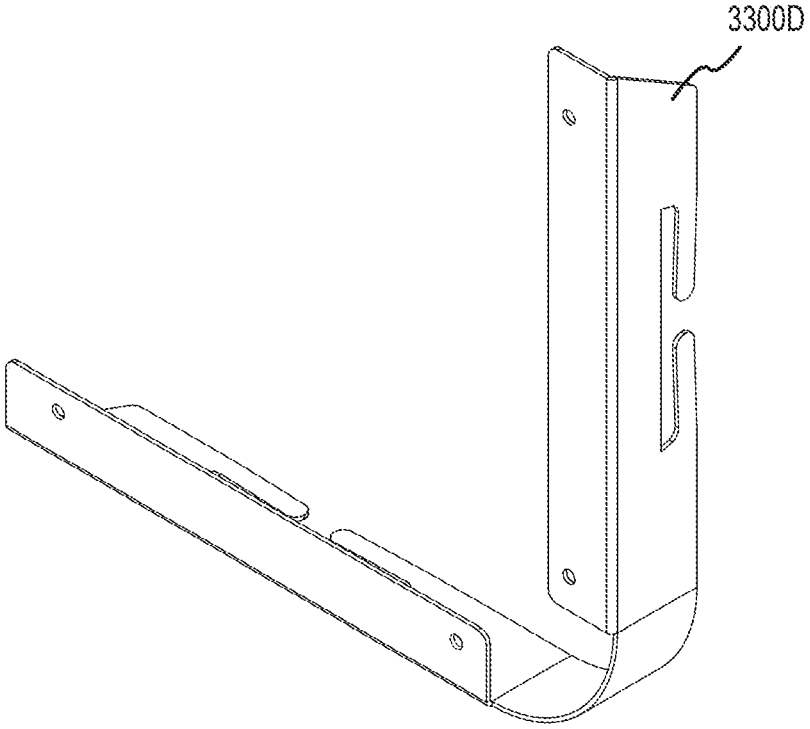

FIGS. 33A-B illustrate isolated components of system 102 illustrated in FIGS. 1A-1B. In one embodiment, one of fence 128A or 128B is provided, such as with peripheral support 106A or 106B. It should be appreciated that a rotated image may be provided to the other of fence 128A or 128B. In one embodiment, fence 3300 is illustrated as one of fence 128. Fence 3300A is illustrated in a side view, fence 3300B is illustrated in a front/rear view, fence 3300C is illustrated in a top/bottom view, and fence 3300D is illustrated in an isometric view.

What is claimed is:

1. An ergonomic keyboard positioning system, comprising a frame;

a keyboard support attached to the frame and accommodating a keyboard upon a keyboard supporting surface of the keyboard support and the keyboard support having a proximate portion adjacent to a user area and a distal portion away from the user area;

a keyboard clamp to attach the keyboard support to the frame at a user-selectable angle of rotation to position a keyboard supporting surface of the keyboard support away from the user area; and a supporting clamp configured to selectively attach the ergonomic keyboard positioning system to a table top via a plurality of engagement members to engage the table top at least one top-facing point of the table top and at least one bottom-facing point of the table top and support the ergonomic keyboard positioning system horizontally beyond the edge of the table surface when attached thereto.

2. The system of claim 1, wherein the angle comprises a value between 20 to 60 degrees, inclusive, as measured between the plane of the keyboard support to a desktop plane.

3. The system of claim 1, further comprising a restraint preventing movement, of a keyboard placed on the keyboard support, towards the distal portion.

4. The system of claim 1, wherein the frame comprises a distally extending arms extending from the keyboard support to engage the underside of a work surface for attachment of the system thereto.

5. The system of claim 1, wherein the frame comprises an attachment portion at a distal end to engage a work surface for attachment thereto and engage the keyboard clamp at the proximal end.

6. The system of claim 5, wherein the attachment portion further comprises:

a lip accommodating an edge of a work surface;

a distally extending support; and a system clamp comprising the lip and a portion of the distally extending support, to securely engage the system to the desk.

7. The system of claim 6, wherein the system clamp comprises a threaded member to adjustably apply a force engaging the system to the desk.

8. The system of claim 6, wherein a portion of the frame between the system clamp and the keyboard clamp is configured to resist play and is devoid of adjustable features.

9. The system of claim 1, further comprising:

a periphery support attached to the frame and accommodating a periphery input device; and wherein the periphery support is selectively adjustable to pitch the periphery support at an angle determined independently from the pitch of the keyboard support.

10. The system of claim 9, wherein:

the user-selectable angle of the keyboard support is obtained by rotation of the keyboard support along a first axis; and the pitch of the periphery support is obtained by rotation of the periphery support along a second axis; and the first axis and the second axis are dissimilar.

11. The system of claim 10, further comprising a restraint to resist motion between a periphery device and the periphery support when a periphery device is placed on the periphery support.

12. The system of claim 9, wherein the frame maintains the periphery support laterally to the keyboard support.

13. The system of claim 1, wherein the keyboard support accommodates a keyboard for use by user simultaneously engaged in the act of standing or walking.

14. The system of claim 1, wherein the keyboard surface pitch is determined by rotation along a portion of the frame supporting the keyboard surface and selectively clamped thereto and providing a fulcrum for the keyboard surface.

15. A method, comprising:

providing a frame to engage a work surface;

supporting, by the frame, a keyboard support at a first user selected angle rotated away from a user; and wherein the angle is determined in accordance with the user's current preference; and wherein the frame further comprises a longitudinal rotational support comprising a longitudinal axis, the longitudinal rotational member pivotably attaching the keyboard support to the frame to enable the user-selectable angle of rotation to comprise a pivot axially parallel with the longitudinal axis.

16. The method of claim 15, wherein the first user selected angle, as measured from the plane of the keyboard support to the plane of the work surface, is between 20 to 60 degrees, inclusive.

17. The method of claim 15, further comprising, providing a peripheral support upon the frame at a second user selected angle determined independently from the first user selected angle.

18. A desk, comprising:

a desk surface;

a frame; and a keyboard support attached to the frame, accommodating a keyboard upon a keyboard supporting surface of the keyboard support, and the keyboard support having a proximate portion adjacent to a user area and a distal portion away from the user area;

wherein the keyboard support is rotationally adjustable to pitch away from the user area and cause the proximate portion to be higher than the distal portion; and wherein the frame further comprises a longitudinal rotational support comprising a longitudinal axis, the longitudinal rotational member pivotably attaching the keyboard support to the frame to enable the user-selectable angle of rotation to comprise a pivot axially parallel with the longitudinal axis.

19. The desk of claim 18, wherein the angle of the pitch, as measured between the plane of the keyboard support to the plane of the desk surface, is between 20 to 60 degrees, inclusive.

20. The desk of claim 18, wherein the frame comprises a substantially straight member with a first end and a second end, and supporting the keyboard support therebetween; and wherein the first end and the second end each engage the desk on opposing sides of an opening within the desk surface.

* * * * *